US010309024B2

(12) United States Patent
Mayer et al.

(10) Patent No.: US 10,309,024 B2
(45) Date of Patent: Jun. 4, 2019

(54) ELECTROPLATING APPARATUS AND PROCESS FOR WAFER LEVEL PACKAGING

(71) Applicant: Novellus Systems, Inc., Fremont, CA (US)

(72) Inventors: Steven T. Mayer, Aurora, OR (US); David W. Porter, Sherwood, OR (US)

(73) Assignee: Novellus Systems, Inc., Fremont, CA (US)

( * ) Notice: Subject to any disclaimer, the term of this patent is extended or adjusted under 35 U.S.C. 154(b) by 0 days.

(21) Appl. No.: 15/958,525

(22) Filed: Apr. 20, 2018

(65) Prior Publication Data

US 2018/0237933 A1 Aug. 23, 2018

Related U.S. Application Data

(60) Division of application No. 15/198,787, filed on Jun. 30, 2016, now Pat. No. 9,982,357, which is a (Continued)

(51) Int. Cl.
*C25D 17/00* (2006.01)
*C25D 3/60* (2006.01)

(Continued)

(52) U.S. Cl.
CPC ..... *C25D 3/60* (2013.01); *C25C 1/20* (2013.01); *C25C 7/00* (2013.01); *C25D 3/56* (2013.01);

(Continued)

(58) Field of Classification Search
None
See application file for complete search history.

(56) References Cited

U.S. PATENT DOCUMENTS 2,511,395 A 6/1950 Baier et al.
3,450,605 A 6/1969 McGivern, Jr.

(Continued)

FOREIGN PATENT DOCUMENTS

CA 2391038 A1 2/2001
CN 1703541 A 11/2005

(Continued)

OTHER PUBLICATIONS

U.S. Final Office Action, dated Apr. 23, 2015 issued in U.S. Appl. No. 13/305,384.

(Continued)

*Primary Examiner* — Stefanie S Wittenberg
(74) *Attorney, Agent, or Firm* — Weaver Austin Villeneuve & Sampson LLP

(57) ABSTRACT

An apparatus for continuous simultaneous electroplating of two metals having substantially different standard electrodeposition potentials (e.g., for deposition of Sn—Ag alloys) comprises an anode chamber for containing an anolyte comprising ions of a first, less noble metal, (e.g., tin), but not of a second, more noble, metal (e.g., silver) and an active anode; a cathode chamber for containing catholyte including ions of a first metal (e.g., tin), ions of a second, more noble, metal (e.g., silver), and the substrate; a separation structure positioned between the anode chamber and the cathode chamber, where the separation structure substantially prevents transfer of more noble metal from catholyte to the anolyte; and fluidic features and an associated controller coupled to the apparatus and configured to perform continuous electroplating, while maintaining substantially constant concentrations of plating bath components for extended periods of use.

19 Claims, 11 Drawing Sheets

Related U.S. Application Data continuation of application No. 13/305,384, filed on Nov. 28, 2011, now Pat. No. 9,404,194.

(60) Provisional application No. 61/502,590, filed on Jun. 29, 2011, provisional application No. 61/418,781, filed on Dec. 1, 2010.

(51) Int. Cl.

| | |
|---|---|
| ***C25D 21/12*** | (2006.01) |
| ***C25D 7/12*** | (2006.01) |
| ***C25D 3/56*** | (2006.01) |
| ***C25D 5/02*** | (2006.01) |
| ***C25D 21/14*** | (2006.01) |
| ***C25D 21/18*** | (2006.01) |
| ***C25C 1/20*** | (2006.01) |
| ***C25C 7/00*** | (2006.01) |
| ***C25D 5/48*** | (2006.01) |

(52) U.S. Cl.

CPC ..... *C25D 5/022* (2013.01); *C25D 5/48* (2013.01); *C25D 7/123* (2013.01); *C25D 17/001* (2013.01); *C25D 17/002* (2013.01); *C25D 21/12* (2013.01); *C25D 21/14* (2013.01); *C25D 21/18* (2013.01)

(56) References Cited

U.S. PATENT DOCUMENTS

| | | | |
|---|---|---|---|
| 3,664,440 | A | 5/1972 | Elenburg |
| 4,003,263 | A | 1/1977 | O'Rourke |
| 4,105,532 | A | 8/1978 | Haines et al. |
| 4,111,772 | A | 9/1978 | Horn |
| 4,330,377 | A | 5/1982 | Franks, Jr. |
| 4,459,185 | A | 7/1984 | Obata et al. |
| 4,565,609 | A | 1/1986 | Nobel et al. |
| 4,767,526 | A | 8/1988 | Vantard |
| 4,828,657 | A | 5/1989 | Fukuoka et al. |
| 4,944,851 | A | 7/1990 | Cordani et al. |
| 5,039,576 | A | 8/1991 | Wilson |
| 5,162,079 | A | 11/1992 | Brown |
| 5,194,141 | A | 3/1993 | Suganuma et al. |
| 5,200,064 | A | 4/1993 | Russ et al. |
| 5,312,539 | A | 5/1994 | Thomson |
| 5,403,460 | A | 4/1995 | Sala et al. |
| 5,409,582 | A | 4/1995 | Wimbish et al. |
| 5,456,756 | A | 10/1995 | Ramaswami et al. |
| 5,518,957 | A | 5/1996 | Kim |
| 5,785,833 | A | 7/1998 | Vaughan |
| 5,883,762 | A | 3/1999 | Calhoun et al. |
| 6,063,172 | A | 5/2000 | Bokisa et al. |
| 6,120,673 | A | 9/2000 | Reiter et al. |
| 6,126,798 | A | 10/2000 | Reid et al. |
| 6,156,167 | A | 12/2000 | Patton et al. |
| 6,251,255 | B1 | 6/2001 | Copping et al. |
| 6,254,742 | B1 | 7/2001 | Hanson et al. |
| 6,333,275 | B1 | 12/2001 | Mayer et al. |
| 6,368,475 | B1 | 4/2002 | Hanson et al. |
| 6,391,179 | B1 | 5/2002 | Ogawa |
| 6,454,927 | B1 | 9/2002 | Stevens et al. |
| 6,458,262 | B1 | 10/2002 | Reid |
| 6,527,920 | B1 | 3/2003 | Mayer et al. |
| 6,551,487 | B1 | 4/2003 | Reid et al. |
| 6,569,299 | B1 | 5/2003 | Reid et al. |
| 6,709,561 | B1 | 3/2004 | Pavlov et al. |
| 6,726,824 | B1 | 4/2004 | Khosla |
| 6,800,187 | B1 | 10/2004 | Reid et al. |
| 6,821,407 | B1 | 11/2004 | Reid et al. |
| 6,878,245 | B2 | 4/2005 | Gandikota et al. |
| 6,878,258 | B2 | 4/2005 | Kovarsky |
| 6,890,416 | B1 | 5/2005 | Mayer et al. |
| 6,899,803 | B2 | 5/2005 | Matejat et al. |
| 6,989,084 | B2 | 1/2006 | Tench et al. |
| 7,178,410 | B2 | 2/2007 | Fraden et al. |
| 7,195,702 | B2 | 3/2007 | Bokisa, Sr. et al. |
| 7,273,540 | B2 | 9/2007 | Sonoda et al. |
| 7,622,024 | B1 | 11/2009 | Mayer et al. |
| 8,128,791 | B1 | 3/2012 | Buckalew et al. |
| 8,262,871 | B1 | 9/2012 | Mayer et al. |
| 8,603,305 | B2 | 12/2013 | Rash et al. |
| 9,045,841 | B1 | 6/2015 | Buckalew et al. |
| 9,139,927 | B2 | 9/2015 | Rash et al. |
| 9,404,194 | B2 | 8/2016 | Mayer et al. |
| 9,534,308 | B2 | 1/2017 | Chua et al. |
| 9,982,357 | B2 | 5/2018 | Mayer et al. |
| 2002/0027080 | A1 | 3/2002 | Yoskioka et al. |
| 2003/0000842 | A1 | 1/2003 | Matejat et al. |
| 2003/0150736 | A1 | 8/2003 | Kovarsky |
| 2004/0000491 | A1 | 1/2004 | Kovarsky et al. |
| 2004/0065540 | A1 | 4/2004 | Mayer et al. |
| 2004/0217005 | A1 | 11/2004 | Rosenfeld et al. |
| 2004/0245113 | A1 | 12/2004 | Bokisa, Sr. et al. |
| 2005/0062169 | A1 | 3/2005 | Dubin et al. |
| 2005/0121317 | A1 | 6/2005 | Klocke et al. |
| 2005/0133374 | A1 | 6/2005 | Kovarsky et al. |
| 2006/0062169 | A1 | 3/2006 | Suzuki et al. |
| 2006/0081478 | A1 | 4/2006 | Sahoda et al. |
| 2006/0086616 | A1 | 4/2006 | Kurashina et al. |
| 2006/0144700 | A1 | 7/2006 | Carson et al. |
| 2006/0144712 | A1 | 7/2006 | Klocke |
| 2010/0032310 | A1 | 2/2010 | Reid et al. |
| 2010/0116674 | A1 | 5/2010 | Luo et al. |
| 2010/0147679 | A1 | 6/2010 | Feng et al. |
| 2011/0226614 | A1 | 9/2011 | Rash et al. |
| 2012/0000786 | A1 | 1/2012 | Mayer et al. |
| 2012/0138471 | A1 | 6/2012 | Mayer et al. |
| 2012/0164341 | A1 | 6/2012 | Hakiri |
| 2013/0334052 | A1 | 12/2013 | Chua et al. |
| 2014/0131211 | A1 | 5/2014 | Rash et al. |
| 2016/0312373 | A1 | 10/2016 | Mayer et al. |
| 2017/0137960 | A1 | 5/2017 | Chua et al. |

FOREIGN PATENT DOCUMENTS

| | | | |
|---|---|---|---|
| CN | 101307482 | A | 11/2008 |
| CN | 101476150 | A | 7/2009 |
| CN | 101855390 | A | 10/2010 |
| EP | 0048579 | A1 | 3/1982 |
| EP | 0048579 | B1 | 12/1984 |
| EP | 2471977 | A2 | 7/2012 |
| JP | S58-144495 | A | 8/1983 |
| JP | 04-024440 | | 4/1992 |
| JP | 11-021692 | | 1/1999 |
| JP | 2000-219993 | | 8/2000 |
| JP | 2004-183091 | | 7/2004 |
| JP | 2004-183091 | A | 7/2004 |
| JP | 2005-133187 | A | 5/2005 |
| JP | 2007-525595 | A | 9/2007 |
| JP | 5186899 | B2 | 4/2013 |
| KR | 10-2001-0090469 | A | 10/2001 |
| TW | I281516 | | 5/2007 |
| WO | WO99/25902 | A1 | 5/1999 |
| WO | WO2004/044272 | A1 | 5/2004 |
| WO | WO2005/076977 | A2 | 8/2005 |
| WO | WO2005/116303 | A1 | 12/2005 |

OTHER PUBLICATIONS

U.S. Final Office Action, dated Feb. 2, 2011, issued in U.S. Appl. No. 11/590,413.

U.S. Final Office Action, dated Feb. 5, 2010, issued in U.S. Appl. No. 11/590,413.

U.S. Notice of Allowance (Supplemental Notice of Allowability), dated Mar. 25, 2015, issued in U.S. Appl. No. 13/359,343.

U.S. Notice of Allowance, dated Aug. 26, 2016, issued in U.S. Appl. No. 13/902,517.

U.S. Notice of Allowance, dated Aug. 7, 2013, issued in U.S. Appl. No. 13/051,822.

U.S. Notice of Allowance, dated Jan. 23, 2018, issued in U.S. Appl. No. 15/198,787.

U.S. Notice of Allowance, dated Jan. 30, 2015, issued in U.S. Appl. No. 13/359,343.

(56) References Cited

OTHER PUBLICATIONS

U.S. Notice of Allowance, dated Jun. 3, 2015, issued in U.S. Appl. No. 14/074,510.
U.S. Notice of Allowance, dated Mar. 28, 2016 issued in U.S. Appl. No. 13/305,384.
U.S. Notice of Allowance, dated Oct. 27, 2011, issued in U.S. Appl. No. 11/590,413.
U.S. Office Action, dated Apr. 19, 2010, issued in U.S. Appl. No. 11/590,413.
U.S. Office Action, dated Aug. 28, 2009, issued in U.S. Appl. No. 11/590,413.
U.S. Office Action, dated Aug. 6, 2010, issued in U.S. Appl. No. 11/590,413.
U.S. Office Action, dated Dec. 31, 2012, issued in U.S. Appl. No. 13/051,822.
U.S. Office Action, dated Jan. 16, 2015, issued in U.S. Appl. No. 14/074,510.
U.S. Office Action, dated Jul. 13, 2017, issued in U.S. Appl. No. 15/198,787.
U.S. Office Action, dated May 11, 2016, issued in U.S. Appl. No. 13/902,517.
U.S. Office Action, dated May 7, 2013, issued in U.S. Appl. No. 13/051,822.
U.S. Office Action, dated May 24, 2011, issued in U.S. Appl. No. 11/590,413.
U.S. Office Action, dated Oct. 8, 2014, issued in U.S. Appl. No. 13/305,384.
Chinese First Office Action dated Aug. 5, 2014 issued in Application No. CN 201110071633.8.
Chinese First Office Action dated Jan. 4, 2017 issued in Application No. CN 201510623134.3.
Chinese First Office Action dated Jul. 23, 2015 issued in Application No. CN 201310221399.1.
Chinese First Office Action dated Jun. 1, 2015 issued in Application No. CN 2011-1040482.0.
Chinese Second Office Action [brief translation] dated Mar. 20, 2015 issued in Application No. CN 201110071633.8.
Chinese Second Office Action dated Dec. 10, 2015 issued in Application No. CN 2011-1040482.0.
Korean First Office Action dated Dec. 12, 2016 issued in Application No. KR 10-2011-0024686.
Korean First Office Action dated Sep. 18, 2017 issued in Application No. KR 10-2011-0127675.
Korean Second Office Action dated Jun. 27, 2017 issued in Application No. KR 10-2011-0024686.
Malaysia Substantive Examination Report dated Mar. 15, 2017 issued in Application No. MY PI2013002017.
Malaysia Substantive Examination Report dated Sep. 15, 2017 issued in Application No. MY PI2013002017.
Taiwan First Office Action and Search Report dated Jan. 13, 2015 issued in Application No. TW 100109635.
Taiwan Office Action and Search Report dated Jan. 26, 2016 issued in Application No. TW 100144031.
Taiwan Office Action and Search Report dated May 2, 2016 issued in Application No. TW 104119312.
Taiwan Office Action and Search Report dated Sep. 4, 2015 issued in Application No. TW 100144031.
Taiwan Office Action dated Jun. 20, 2017 issued in Application No. TW 106100777.
U.S. Office Action, dated Feb. 18, 2011, issued in U.S. Appl. No. 11/895,911.
U.S. Appl. No. 11/895,911, filed Aug. 27, 2007, Buckalew et al.
U.S. Notice of Allowance, dated Jun. 6, 2018, issued in U.S. Appl. No. 15/360,757.
U.S. Appl. No. 16/122,589, filed Sep. 5, 2018, Chua et al.

ELECTROPLATING APPARATUS AND PROCESS FOR WAFER LEVEL PACKAGING

CROSS-REFERENCE TO RELATED APPLICATIONS

This application is a division of and claims priority to the U.S. application Ser. No. 15/198,787 filed Jun. 30, 2016 (issued as U.S. Pat. No. 9,982,357 on May 29, 2018), titled "ELECTROPLATING APPARATUS AND PROCESS FOR WAFER LEVEL PACKAGING" naming Mayer et al. as inventors, which is a continuation of U.S. application Ser. No. 13/305,384 filed Nov. 28, 2011 (issued as U.S. Pat. No. 9,404,194 on Jun. 7, 2012), titled "ELECTROPLATING APPARATUS AND PROCESS FOR WAFER LEVEL PACKAGING" naming Mayer et al. as inventors, which claims benefit of prior U.S. Provisional Application No. 61/418,781 filed Dec. 1, 2010, titled "ELECTROPLATING APPARATUS AND PROCESS FOR WAFER LEVEL PACKAGING" naming Mayer et al. as inventors, and of prior U.S. Provisional Application No. 61/502,590 filed Jun. 29, 2011, titled "ELECTRODEPOSITION WITH ISOLATED CATHODE AND REGENERATED ELECTROLYTE" naming Mayer as the inventor, which are herein incorporated by reference in their entirety and for all purposes.

FIELD OF THE INVENTION

The present invention pertains to the methods and apparatus for simultaneous electrodeposition of two metals having substantially different standard electrodeposition potentials. Specifically, this invention pertains to the methods and apparatus for simultaneous electrodeposition of tin and silver for wafer level packaging applications.

BACKGROUND

Electrochemical deposition processes are well-established in modern integrated circuit fabrication. The movement from aluminum to copper metal lines in the early years of the twenty-first century drove a need for more sophisticated electrodeposition processes and plating tools. Much of the sophistication evolved in response to the need for ever smaller current carrying lines in device metallization layers. These copper lines are formed by electroplating the metal into very thin, high-aspect ratio trenches and vias using a methodology commonly referred to as "damascene" processing.

Electrochemical deposition is now poised to fill a commercial need for sophisticated packaging and multichip interconnection technologies known generally as wafer level packaging (WLP) and through silicon via (TSV) electrical connection technology. These technologies present their own very significant challenges.

For example, these technologies require electroplating on a significantly larger feature size scale than most damascene applications. For various types of packaging features (e.g., TSV through chip connections, redistribution wiring, fan-out wiring, or flip-chip pillars), plated features are frequently, in current technology, greater than about 2 micrometers and typically 5-100 micrometers in height and/or width (for example, pillars may be about 50 micrometers). For some on-chip structures such as power busses, the feature to be plated may be larger than 100 micrometers. The aspect ratios of the WLP features are typically about 1:1 (height to width) or lower, while TSV structures can have very high aspect ratios (e.g., in the neighborhood of about 10:1 to 20:1).

Given the relatively large amount of material to be deposited, plating speed also differentiates WLP and TSV applications from damascene applications. For many WLP applications involving copper and/or nickel deposition, features have been filled at a rate of at least about 1 micrometer/minute or more and solder is plated at a rate of about 2.5 micrometers/minute or more. Currently copper depositions rates of about 2.5 micrometers/minute are employed and solder plating rates of 3-5 micrometers/minute are used. In the future these rates are anticipated to increase to as high as 3.5 micrometers/min and 6 micrometers/min respectively. Further, independent of the plating rate, the plating must be conducted in a global and locally uniform manner on the wafer, as well as from one wafer to the next.

Still further, electrochemical deposition of WLP features may involve plating various combinations of metals such as the layered combinations or alloys of lead, tin, indium, silver, nickel, gold, palladium and copper.

While meeting each of these challenges, WLP electrofill processes must compete with conventionally less challenging and potentially less inexpensive pick and place (e.g. solder ball placement) or screen printing operations.

SUMMARY

An apparatus and method for continuous simultaneous electroplating of two metals having substantially different standard electrodeposition potentials (e.g., for deposition of Sn Ag alloys) is provided. The apparatus includes an anode chamber for containing an anolyte comprising ions of a first, less noble metal, (e.g., tin), but not of a second, more noble, metal (e.g., silver) and an active (also called a "soluble") anode which comprises the first metal; a cathode chamber for containing catholyte including ions of a first metal (e.g., tin), ions of a second, more noble, metal (e.g., silver), and the substrate; a separation structure positioned between the anode chamber and the cathode chamber, where the separation structure allows for the flow of ionic current (ionic communication) but substantially prevents transfer of more noble metal from catholyte to the anolyte during plating; and fluidic features and an associated controller coupled to the apparatus and configured to perform continuous electroplating, while maintaining substantially constant concentrations of metal ions, protons, anions, and generally any other plating bath component (e.g., additive or complexing agents) in the cathode chamber for extended periods of use. Specifically, concentrations of the first metal, the second metal, and of protons in catholyte can be maintained, such that each does not fluctuate by more than about 20%, such as by more than about 10% over the period of at least about 0.2 bath charge turnovers, at least about 0.5 bath charge turnovers, at least about 2 bath charge turnovers, or at least about 10 bath charge turnovers.

Concentrations of the first metal and of protons in the anolyte, in some embodiments (e.g. after reaching steady state concentrations after initial anolyte charging), can be maintained such that each does not fluctuate by more than about 20%, such as by more than about 10% over the period of at least about 0.2 bath charge turnovers, at least about 0.5 bath charge turnovers, at least about 2 bath charge turnovers, or at least about 10 bath charge turnovers. For example, in many embodiments, proton concentration in the anolyte does not fluctuate by more than about 10% over the period of at least about 0.2 bath charge turnovers, such as for a period of at least about 2 bath charge turnovers.

In addition to stability of the plating bath over extended periods of use, the provided apparatus and methods offer substantial cost savings by minimizing the use of expensive electrolyte material and generation of expensive waste containing electrolyte material, by providing a system designed to minimize or eliminate decomposition reactions in the electrolyte, and/or by regenerating metals from spent portions of electrolyte.

As it was mentioned, provided apparatus includes a separation structure, which does not permit flow of the more noble metal from the caholyte into anolyte. Suitable materials for the separation structure include ionomers, such as polyfluorinated ionomers, and cationic membrane materials, e.g., Nafion® available from Du Pont de Nemours. The ionomer may be placed on a solid support, which would provide mechanical strength to the separation structure. The separation structure is typically permeable to water and to protons, which flow through the membrane from anolyte to catholyte during electroplating. In some embodiments the separation structure is also permeable to the ions of the first metal (e.g., tin) during plating (but not necessarily in the absence of applied potential). In preferred embodiments, ions of the first metal can flow in part by forced migration (i.e. under the influence of an applied electric field) through the membrane from anolyte to catholyte during electrodeposition, while the second metal (e.g. silver) does not substantially cross the membrane during idle or during plating because its diffusion to anolyte is substantially inhibited (e.g., by the separator and/or due to complexation) and because the anodically applied electric field generally prevents any forced migration in the opposite direction (migration of a cation is from the positive anode through the anolyte to catholyte to the cathode). In one embodiment, the apparatus includes the following fluidic features and an associated controller coupled to the apparatus and configured to perform at least the following operations: deliver an acid solution to the anode chamber from a source outside the anode chamber; deliver a solution comprising ions of the first metal (e.g., tin) to the anode chamber from a source outside the anode chamber; remove a portion of the catholyte from the cathode chamber; deliver ions of a second metal (e.g., silver) to the cathode chamber (via delivery of a solution comprising ions of the second metal and/or using an auxiliary anode comprising the second metal); and deliver anolyte from the anode chamber to the cathode chamber via a conduit that is different than the separation structure.

The controller associated with the apparatus can control flow rates and delivery timing of all components introduced into the system including delivery of acid to the anolyte, delivery of ions of the first metal to the anolyte, delivery of anolyte to catholyte, and delivery of ions of the second metal to the catholyte. In addition to controlling addition of acid and first metal (e.g. tin) feed solutions to anolyte, in some embodiments the controller is configured to control the flow and delivery timing of water to the anolyte (allowing for highly concentrated acid and tin solutions to be used in acid and tin feed solutions). The controller also is configured to control either actively or passively (e.g. via displacement volume and overflow to waste of regeneration streams) the rate of removal of the catholyte from the cathode chamber. The delivery of electrolyte components can be controlled in a feed-forward predictive manner coulometrically (e.g., dosing of components such as acid, tin, silver or additives can occur after a pre-determined number of coulombs passed through the plating system). In some embodiments, the controller further receives feedback signals related to the measured concentrations of components in the plating bath (e.g., proton, tin, silver, additive or complexer concentrations in the anolyte), and adjusts delivery or removal of electrolyte components in response to received signals, e.g., either through addition of new material and/or removal of bath directly to the catholyte (catholyte direct dosing and control) or indirectly through the anolyte (indirect corrective dosing of acid and tin).

In some embodiments the apparatus includes an anolyte pressure regulator in fluid communication with the anode chamber. In some embodiments, the anolyte pressure regulator comprises a vertical column arranged to serve as a conduit through which the electrolyte flows upward before spilling over a top of the vertical column into a chamber exposed to air or inert gas at atmospheric pressure, and wherein, in operation, the vertical column provides a pressure head which maintains a substantially constant pressure throughout the anode chamber. The pressure regulator can be incorporated into an anolyte circulation loop which circulates anolyte out of the anode chamber, through the pressure regulator, and back into the anode chamber, e.g., across the anode metal. The anolyte circulation loop typically further comprises a pump outside the anode chamber, and an inlet for introducing additional fluid (including water, acid solution, and a solution comprising the ions of the first metal) into the anolyte circulation loop. Typically the apparatus will also include a source of acid and a source of ions of a first metal fluidically coupled to the anode chamber. For example, the apparatus may include an internal apparatus or may be otherwise connected to an auxiliary system (e.g., a bulk chemical delivery system) that provides a source of pressurized acid and a source of ions of a first metal fluidically coupled to the anode chamber.

Ions of the second metal (e.g., silver) are not contained within the anolyte but are delivered to the catholyte using one or both of the following systems. In a first system, the apparatus includes a source of a solution of ions of a second metal (e.g., a solution of a silver salt) outside the cathode chamber and in fluid communication with the cathode chamber. In a preferred embodiment that same solution source further contains an appropriate first-metal complexing agent or agents present such as to keep the first metal dissolved in the catholyte solution and/or to avoid oxidation of the second metal when mixed into the catholyte containing the second metal. The solution of ions of the second metal is delivered to the catholyte from the source as needed to maintain the catholyte second metal concentration In a second system, the apparatus includes an auxiliary active anode, comprising the second metal, e.g., a silver-containing anode (e.g., pure silver anode, or silver in combination with other materials). The anode is positioned in fluid communication with the cathode chamber (e.g., in the cathode chamber or in an auxiliary chamber outside the cathode chamber fluidically connected to the cathode chamber), but separate from and not in the anode chamber. The anode is connected to a power supply whose negative terminal is connected to the wafer substrate. This secondary metal anode is positively (anodically) biased during electroplating and electrochemically dissolves, providing ions of the second metal to the catholyte, in such a manner that these ions do not transfer to the anode chamber. The current applied to the secondary metal anode from the secondary metal anode power supply relative to the primary metal anode via the primary power supply should be balanced so as to maintain the concentration of second metal in the catholyte at the target concentration determined to be appropriate for delivering a target concentration of the second metal in the wafer deposit. A porous filter-like membrane may be used to avoid particles generated by the second anode from reaching the wafer. A combined apparatus having both an auxiliary silver anode and a source of silver ions feeding the catholyte can also be used.

In some embodiments the apparatus further includes an ionically resistive ionically permeable element shaped and configured to be positioned adjacent the substrate in the cathode chamber and having a flat surface that is adapted to be substantially parallel to and separated from a plating face of the substrate by a gap of about 5 millimeters or less during electroplating, wherein the ionically resistive ionically permeable element has a plurality of non-interconnected holes.

In some embodiments the apparatus further includes a system for recovering or regenerating metals (e.g., tin and/or silver) from spent electrolyte. In some embodiments, the apparatus includes a system adapted for receiving catholyte removed from the cathode chamber and, optionally, a bath in fluid communication with the cathode chamber. The regeneration system is configured for removing silver from catholyte (e.g., by selectively electrowinning at a required potential), and then delivering the remaining silver-free solution (regenerated anolyte) which contains tin ions to the anolyte chamber. In some embodiments the system is adapted to first remove a fraction of the catholyte removed from the system, process the remaining removed fraction to remove silver therein (creating a regenerated anolyte), and then combine the regenerated anolyte with fresh anolyte to the anolyte chamber.

In some embodiments an apparatus for simultaneous electroplating of a first metal and of a second, more noble metal on a cathodic substrate, includes: (a) a cathode and anode chambers having a separation structure therebetween; and (b) a controller comprising program instructions for conducting a process comprising the steps of: (i) providing an anolyte containing ions of the first metal but not the second metal in the anode chamber comprising an active anode comprising the first metal; (ii) providing a catholyte containing ions of both the first metal and the second metal in the cathode chamber; and (iii) simultaneously plating the first and the second metal onto the substrate while substantially preventing ions of the second metal from entering the anode chamber, while delivering an acid solution to the anode chamber from a source outside the anode chamber, while delivering a solution comprising ions of the first metal to the anode chamber from a source outside the anode chamber, while removing a portion of the catholyte from the cathode chamber, while delivering ions of the second metal to the cathode chamber, while delivering anolyte from the anode chamber to the cathode chamber via a conduit other than the separation structure, wherein the apparatus is configured to maintain the concentration of protons in the catholyte such that it does not fluctuate by more than about 10% over the period of at least about 0.2 plating bath charge turnovers.

In another aspect, a system is provided, which includes an apparatus as any of the described above and a stepper, e.g., configured for photolithographic processing.

In another aspect, a continuous method of simultaneously plating a first metal and a second more noble metal onto a cathodic substrate (e.g., integrated circuit chip) is provided. The method includes the following operations: (a) providing an anolyte containing ions of the first metal but not the second metal in an anode chamber comprising an active anode comprising the first metal; (b) providing a catholyte containing ions of both the first metal and the second metal in a cathode chamber, wherein the anode chamber and the cathode chamber are separated by a separation structure therebetween; and (c) simultaneously plating the first and the second metal onto the substrate, while substantially preventing ions of the second metal from entering the anode chamber, while delivering an acid solution to the anode chamber from a source outside the anode chamber, while delivering a solution comprising ions of the first metal to the anode chamber from a source outside the anode chamber, while removing a portion of the catholyte from the cathode chamber, while delivering ions of the second metal to the cathode chamber, while delivering anolyte from the anode chamber to the cathode chamber via a conduit other than the separation structure, wherein the catholyte and anolyte comprise acid and wherein the concentration of protons in the catholyte is maintained such that it does not fluctuate by more than about 10% over the period of at least about 0.2 plating bath charge turnovers.

In some embodiments, the separation structure comprises a cationic membrane, configured for transporting protons, water, and ions of the first metal from anolyte to catholyte during plating. In some embodiments the first metal is tin, and the second metal is silver. Delivery of silver ions to the catholyte can include delivering a solution containing silver ions to the catholyte from a source outside the catholyte and/or electrochemically dissolving an auxiliary silver anode fluidically connected with the catholyte.

In some embodiments, the catholyte includes silver ions in a concentration of between about 0.5 and 1.5 grams/liter and tin ions in a concentration of between about 30 and 70 grams/liter. In some embodiments the catholyte further includes organic plating additives, while anolyte is substantially free of organic plating additives.

In some embodiments the composition of anolyte and catholyte is maintained substantially constant using a coulometric control. In some embodiments, the composition of anolyte and catholyte is maintained substantially constant using a coulometric control and feedback signals related to concentrations of electrolyte components.

In some embodiments the catholyte and anolyte contain tin (e.g., low alpha tin), and the method further includes regenerating tin from removed portions of catholyte, where such regeneration includes separating tin from silver by electrowinning silver at a controlled potential. The tin-containing silver-free solution formed after electrowinning can be delivered to the anode chamber.

In some embodiments the method includes operations of applying photoresist to the workpiece; exposing the photoresist to light; patterning the resist and transferring the pattern to the workpiece; and selectively removing the photoresist from the workpiece.

In another aspect, a non-transitory computer machine-readable medium comprising program instructions for control of an electroplating apparatus is provided. The program instructions include code for performing the methods described herein. In some embodiments the instructions include code for: providing an anolyte containing ions of the first metal but not the second metal in an anode chamber comprising an active anode comprising the first metal; providing a catholyte containing ions of both the first metal and the second metal in a cathode chamber, wherein the anode chamber and the cathode chamber are separated by a separation structure therebetween; and simultaneously plating the first and the second metal onto the substrate, while substantially preventing ions of the second metal from entering the anode chamber, while delivering an acid solution to the anode chamber from a source outside the anode chamber, while delivering a solution comprising ions of the first metal to the anode chamber from a source outside the anode chamber, while removing a portion of the catholyte, while delivering ions of the second metal to the cathode chamber, while delivering anolyte from the anode chamber to the cathode chamber via a conduit other than the separation structure, wherein the catholyte and anolyte comprise acid and wherein the concentration of protons in the catholyte is maintained such that it does not fluctuate by more than about 10% over the period of at least about 0.2 plating bath charge turnovers.

These and other features and advantages of the present invention will be described in more detail below with reference to the associated drawings.

DETAILED DESCRIPTION

Figure 1:
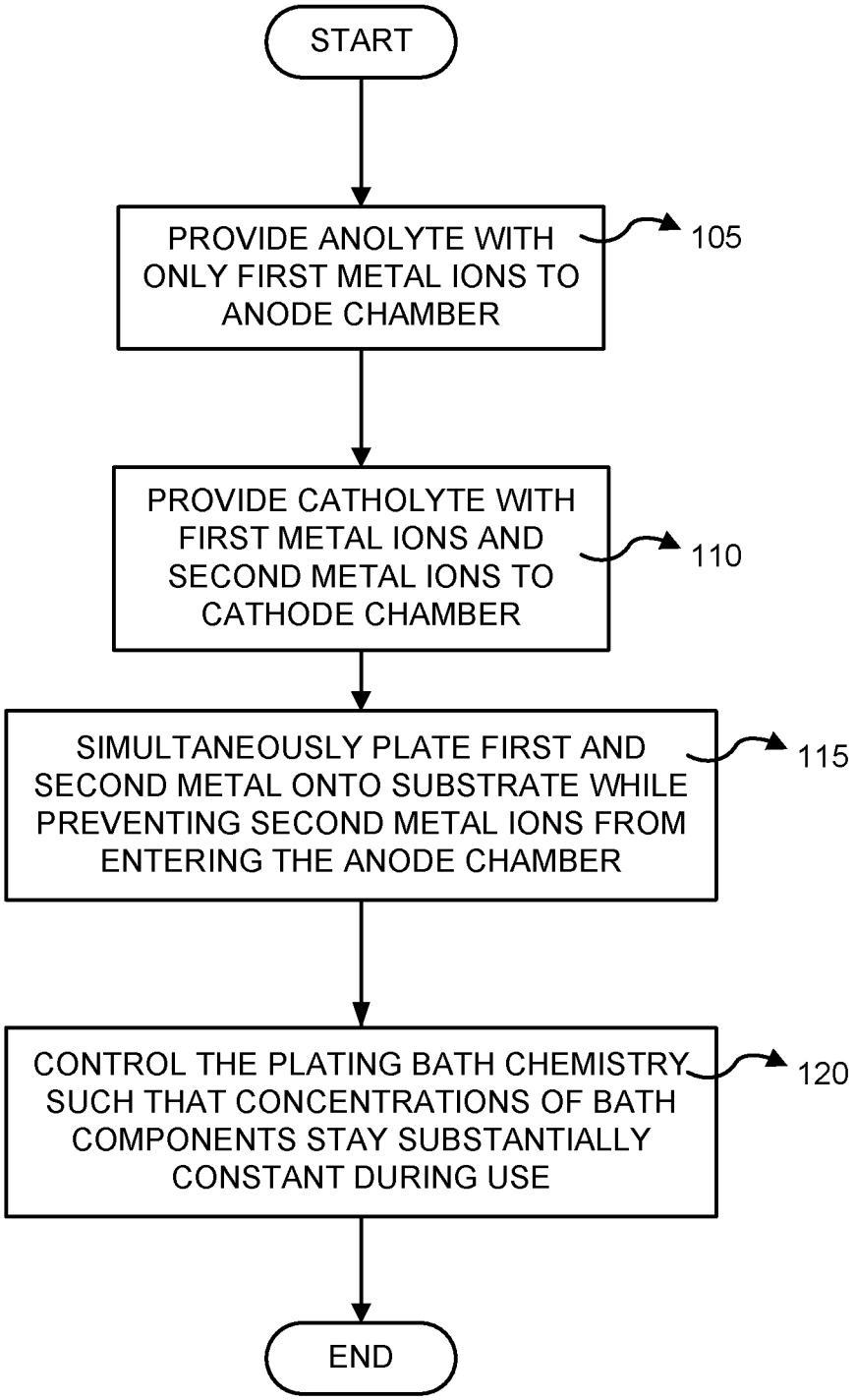
FIG. 1 is a process flow diagram for a method of simultaneous plating of two metals provided herein.

Methods and apparatus provided herein are suitable for simultaneous electrodeposition of at least two metals having different electrodeposition potentials. These methods are particularly useful for depositing metals having a large difference in standard electrodeposition potentials, such as a difference of at least about 0.3 V, more preferentially 0.5 V or more. These methods will be illustrated using simultaneous electrodeposition of tin (less noble metal) and silver (more noble metal) as an example. It is understood that provided apparatus and methods can also be used for simultaneous electrodeposition of other metal combinations (including alloys and mixtures), such as combinations of tin and copper, nickel and silver, copper and silver, indium and silver, iron and nickel, gold and indium, or two metal micro-mixtures such as gold and copper or copper and nickel. Electrodeposition of more than two metals can also be accomplished. For example, known ternary lead free alloys of tin, copper and silver, can be electrodeposited using methods and apparatus provided herein.

It is noteworthy that in some embodiments, low alpha tin is employed in the plating systems provided herein as a first, less noble metal. Low alpha tin is tin of extremely high chemical purity with low alpha particle emitted levels (e.g. less than about 0.02, more preferably less than about 0.002 alpha emission counts per $cm^2$ per hour). The combination of purity and aging of the material results in a product that does not have significant amounts of contaminants remaining that undergo radioactive alpha decay. This is significant for IC applications, because alpha emission in the semiconductor chips can cause reliability problems and can interfere with IC function. Accordingly, in some embodiments, the tin anode that is used in the provided apparatuses contains low alpha tin. Further, solutions of stannous ions delivered to the electrolyte also are low alpha tin grade. Importantly, low alpha tin in solution is a more expensive material (weight for weight) than metallic low alpha tin or silver. Therefore, it is highly advantageous that provided apparatuses and methods produce very little, if any, low alpha tin waste.

Introduction and Overview

Electrochemical deposition may be employed at various points in the integrated circuit (IC) fabrication and packaging processes. At the IC chip level, damascene features are created by electrodepositing copper within vias and trenches to form multiple interconnected metallization layers. Above the multiple metallization layers, the "packaging" of the chip begins. Various WLP structures may be employed, some of which contain alloys or other combinations of two or more metals or other components. For example, the packaging may include one or more "bumps" made from solder or related materials. In a typical example of a plated bump manufacturing, the processing starts with a substrate having a conductive seed layer (e.g. a copper seed layer) having an "underbump" diffusion barrier layer of plated nickel (e.g. 1-2 μm thick and 100 μm wide) under a film of lead tin solder plated pillar (e.g. 50 to 100 microns thick and 100 microns wide). In accordance with the methods provided herein the solder pillar is made of electrodeposited tin silver instead of lead tin. After plating, photoresist stripping, and etching of the conductive substrate copper seed layer, the pillar of solder is carefully melted or "reflowed" to create a solder "bump" or ball attached to the underbump metal. An underbump of a non-solder high melting point plated metal solder "pedestal" such as copper, nickel, or a layered combination of these two, is often created below a solder film. More recently, the squat pedestals are replaced with smaller and higher aspect ratio pillars of the high melting metals (e.g., nickel and/or copper) resulting in reduced use of solder. In this scheme, useful in achieving tight and precise feature pitch and separation control, the copper pillars may be, for example, 50 microns or less in width, features can be separated from one another by 75-100 micron center to center, and the copper may be 20-40 microns in height. On top of the copper pillar, a nickel barrier film, e.g., about 1-2 microns thick, is sometimes deposited to separate the copper from the tin-containing solder and thereby avoid a solid state reaction of copper and tin which results in formation of various undesirable bronzes. Finally, a solder layer (conventionally a Sn—Pb layer, but a Sn—Ag layer according to embodiments of this invention) typically 20-40 microns in thickness is deposited. This scheme also enables a use of reduced amount of solder for the same feature sizes, reducing the cost of solder or reducing the total amount of lead in the chip. Recently, a move away from lead-containing solders has increased in momentum due to environmental and health safety concerns. Tin-silver solder alloy bumps are of particular interest and are used as an example to describe various embodiments described herein.

Lead-tin materials provide good quality "bumps" for packaging and are very easy to plate. However, lead's toxicity is driving a movement away from its use. For example, the RoHS initiative (Directive 2002/95/EC of The European Parliament) requires entities to change from the established tin-lead process to a lead free one. Replacement bump materials include tin, tin-silver binary materials, and tin-silver-copper ternary materials. Tin alone, however, suffers from a number of fundamental limitations and causes application difficulties due to its tendency to form large single-grained balls with varying orientations and thermal expansion coefficients, and due to its tendency to form "tin wiskers" which can lead to interconnect-to-interconnect shorting. The binary and ternary materials generally perform better and alleviate some of these pure tin issues, at least in part by precipitating a large number of small grain inclusions of the non-tin component as part of the solder melt to solid state freezing process.

However, electrochemical deposition of silver-tin alloys is accomplished by a difficult process that frequently employs an inert anode. Part of the difficulty results from the very widely separated electrochemical deposition potentials of silver and tin; the standard electrochemical potentials ($E_0$s) of the metals are separated by more than 0.9 volts ($Ag^+/Ag$: 0.8V NHE, $Sn^{+2}/Sn$: −0.15V). Stated another way, elemental silver is substantially more inert than elemental tin and therefore will electroplate out of solution first much more easily than tin.

The large deposition potential difference between silver and tin can be and often is reduced by keeping the concentration of the nobler element (silver) as low as possible and the base (less noble) element (tin) as high as possible. Such a change in thermodynamic potential would follow the Nernst equation, with its logarithmic voltage vs. concentration dependence. However, that equation predicts only a ~0.06V decrease in potential for each order of magnitude decrease in concentration for a one electron change process (e.g. $Ag^+$, and proportionately less for multi-electron processes), and therefore is not able to fully compensate for the potential difference of such widely differing metals. Furthermore, the rate of deposition, as dictated by boundary layer theory, decreases linearly with concentration, and therefore maintaining significant levels of the nobler element in the film deposit inherently requires its concentration to be substantial (e.g. >0.1 g/L) in the plating solution. Hence, typically, the concentration of nobler element is relatively low but not insignificant in the plating solution, and the deposition processes are controlled in a manner whereby silver concentration in the bath is carefully controlled and silver is plated at its diffusion limiting rate (i.e., at its limiting current).

Another relevant issue in the silver tin system is the oxidation of base metal ion to a higher oxidation state by a direct homogeneous or indirect heterogeneous reaction with an oxidizing agent. Potential oxidizing agents include the nobler bath element (e.g. Ag+), dissolved molecular oxygen in an acidic medium, or a bath organic additive. In particular, the stannous ($Sn^{+2}$) ion has the potential to be oxidized to a stannic ion ($Sn^{+4}$) or other $Sn^{4+}$-containing species by these oxidizers, as shown by half-reactions (1), (2), and (3).

$$Sn^{+2} \rightarrow Sn^{+4} + 2e^- \ (E_o = +0.15V) \quad (1)$$

$$Ag^+ + e^- \rightarrow Ag \ (E_o = 0.799V) \quad (2)$$

$$O_2 + 4H^+ + 4e \rightarrow 2H_2O \ (E_o = 1.29V \text{ NHE}) \quad (3)$$

Again, a low concentration of dissolved oxygen and silver would reduce the potential driving force for such a reaction. Also, as indicated above, one will not be able to reduce the concentration of silver in the bath sufficiently to substantially reduce the driving potential to a low enough value. Further, as discussed below, in the absence of employing the various features disclosed herein, an inert anode (also called a "dimensionally stable anode") must be used, and that inherently creates substantial amounts of dissolved oxygen (by the reverse of the above reaction). The influence of the oxygen reaction can be partially alleviated by adding an oxygen getter as an additive to the plating solution (e.g. hydroquinone), but the amount of oxygen generated by an inert anode will quickly overcome any oxygen getting capacity of the additive to the bath. To combat the more noble metal (silver) faradic displacement, one can use a strong complexing (e.g., chelating) agent to reduce the amount of "free" silver ion and correspondingly shift the reaction in the desired direction. A very strong and electrochemically and chemically stable complexing agent with a complexation reaction constant of $10^{-11}$ or $10^{-12}$ would be required to decrease the potential of the silver ion reduction reaction to that of the stannous to stannic couple.

Another issue in the deposition of the Sn—Ag couple is that in the conventional systems it is not possible to use an active anode of the less noble member (tin) as it will undergo oxidation in the presence of the nobler ion (silver) in solution. The associated displacement reaction rules out the possibility of using a tin containing active anode, since direct displacement of the metallic tin will occur spontaneously, depleting the already small concentration of silver in the bath rapidly. The potential of the anode during corrosion remains equal to that of the less noble component tin even after silver has been plated onto the anode, and so the silver can not be re-oxidized easily or efficiently.

However, the use of an inert anode has several quite negative ramifications as further described below. One is that the plating bath chemistry is not balanced. The oxygen evolution reaction at the anode (according to reaction 4) continually increases the acidity of the bath. At the same time, the depletion of tin and silver requires replenishment by adding more salts. Without a large volume bath bleeding process, which may be difficult to control, the total ionic concentration can exceed the solubility limits of dissolved ions, and the bath must be depleted to avoid precipitation. This is both financially and environmentally undesirable. Also, the stannous ($Sn^{2+}$) to stannic ($Sn^{4+}$) oxidation reaction can occur at the anode in parallel with the oxygen evolution reaction. Stannic ion is considered to be insoluble except in very concentrated halide-containing acid. However, halides are unsuitable in a silver plating solution because silver halides are insoluble. A typical tin silver plating bath, such as that based on methanesulfonic acid and methanesulfonate metal salts, can not dissolve stannic oxide and therefore will continuously create conditions for the precipitation of stannic oxide (by reaction with water and dissolved oxygen generated electrolytically, (4)).

$$2H_2O + Sn^{+2} \rightarrow 4H^+ + O_2 + 4e^- + Sn^{+2} \rightarrow 4H^+ + SnO_2 + 2e^- \quad (4)$$

This results in reduced cell efficiency requiring additional metal salt to be added, as well as a particle-laden plating bath which is undesirable for defect control and/or can necessitate constant filtration and filter changes.

Hence, these and other challenges result in frequent plating bath changes, non-uniform silver concentration in the plated material, and relatively slow plating (typically less than 3 micrometers/minute).

Various embodiments described herein pertain to plating silver-tin compositions. However, it should be understood that the principles described with respect to these embodiments apply equally to electrochemical deposition of other multi-component materials, and particularly to those in which two or more of the electrodeposited materials have widely separated, electrochemical deposition potentials (e.g., $E_0$s separated by at least about 0.3 volts, more preferably 0.5 volts). Other than in the specific compositions and conditions set forth below, references to tin can be replaced with "less noble metal" and references to silver can be replaced with "more noble metal." Additionally it should be understood that the principles described herein can be applied to processes for electrodepositing three or more separate elements, at least two of which are have electrochemical deposition potentials separated by a wide margin, e.g., at least about 0.5 volts.

Apparatus and Methods

Problems discussed above are addressed, in some embodiments, by providing an apparatus that is capable of using an active (consumable) anode containing the less noble metal (e.g. tin), where the active anode substantially does not come into contact with the ions of a more noble metal (e.g. silver) during plating. To this end, the plating cell contains a cathode chamber configured for holding catholyte and a substrate (which is cathodically biased during plating) and an anode chamber configured for holding anolyte and the anode, where the anode chamber and the cathode chamber are separated by a separation structure, and where the anolyte contained in the anode chamber is substantially free of metal ions of the nobler metal. In some embodiments the anolyte is also substantially free of plating bath additives known in the art, including grain refiners, brighteners, levelers, suppressors, and noble metal complexing agents. The anolyte is electrolyte that contacts the anode and has a composition appropriate for contacting the anode and allowing it to create a soluble anode metal species upon electrochemical dissolution of the anode. In the case of tin, the suitable anolyte should preferably be either highly acidic (preferably with pH of less than 2) and/or contain a tin complexing agent (e.g. a chelator such as an oxalate anion). Conversely, the catholyte is electrolyte that contacts the cathode and has a composition appropriate for that role. For tin/silver plating, one exemplary catholyte would contain acid (e.g., methanesulfonic acid), a salt of tin (e.g., tin methanesulfonate), silver complexed with a silver complexer (e.g., silver complex with a thiol-containing complexer), and a grain refiner (e.g. polyethyleneclycol (PEG), hydroylated cellulose, gelatin, peptone, etc.). The separator helps maintain the distinct compositions of the anolyte and the catholyte within the electroplating chamber, even during electroplating, by selectively excluding certain electrolyte components from passage through the separator. For example, the separator can prevent the ions of a nobler metal from flowing from catholyte to anolyte. The term "flow" as used herein encompasses all types of ion movement.

The following principles can be employed in designing an electroplating apparatus and/or process suitable for plating a composition containing a more noble element and a less noble element: (1) the less noble element is provided in the anode chamber, (2) a soluble compound of the more noble element (e.g., a salt of that element, often in a complexed form) is blocked from transport from the cathode chamber to the anode chamber, e.g., by the separator and (3) the soluble compound of the more noble element is applied to the cathode chamber only (not to the anode chamber). In a preferred embodiment, the less noble element is provided at least via a consumable anode containing that element (and can be also provided in solution in addition to consumable anode), which is electrochemically dissolved during plating.

The method described herein is illustrated by FIG. 1, which summarizes the process of simultaneous plating using anolyte and catholyte of distinct compositions. As mentioned in operation 105, anolyte containing only first (less noble) metal ions is provided to the anode chamber. In operation 110, a catholyte containing both ions of first (less noble) and second (more noble) metals is provided to the cathode chamber. Operations 105 and 110 need not be sequential, and can occur simultaneously. Next, in operation 115, first and second metals are plated onto the substrate while preventing the second metal from entering the anode chamber. This is typically accomplished by using a separator which is substantially impermeable to ions of the nobler metal during plating. During plating, the substrate (e.g., a semiconductor wafer, such as an IC chip containing recessed features as any of the recessed features described above) is negatively biased relative to anode and its working surface is immersed into catholyte. The substrate and the anode are electrically connected to a power supply, which provides sufficient potential to cause plating of metals contained in the catholyte on the substrate. In operation 120, the plating bath chemistry is controlled such that concentrations of bath components stay substantially constant during use. This includes controlling addition (feed) streams and removal (bleed) streams provided to and from the plating apparatus.

As indicated, various embodiments described herein employ some mechanism to keep the more noble metal ions (silver in the examples) from reaching the anode. Such mechanism may also exclude organic plating additives such as accelerators, suppressors, complexers, grain refiners, and/or levelers from contacting the anode. If silver ions were to contact a tin anode, they would simply deposit on tin anode and be continually extracted from solution. Concurrently, the tin would be corroded and tin ions would enter the electrolyte by a displacement reaction. Once silver metal deposits on the tin anode, it cannot be easily removed electrolytically. So long as tin metal is available in the anode and exposed to the solution, generally the applied potential can never become sufficiently anodic to strip it off the silver.

The suitable compositions of anolyte and catholyte are provided in non-limiting examples below.

Composition of Anolyte

In various examples—employing a plated metal composition of about 1-3% silver and 97-99% tin—the anolyte may have the following composition at start up. Composition at start up in some embodiments may be different than the composition of anolyte during steady state operation in continuous plating. Concentrations of tin in electrolyte refer to concentrations of tin ions (without anion) throughout the description.

Example 1

Tin—160-240 g/l

Silver—none

Acid—40-140 g/l acid (based on methanesulfonic acid (MSA))

Organic additives—none

Example 2

Tin—230 g/L
Silver-None
Acid—80 g/L as MSA
Organic Additive:
Ishihara TS202-AD (grain refining additive) available from Ishihara Chemical Co., LTD., Kobe, Japan: 40 g/L
Ishihara TS-SLG (Silver Complexer) available from Ishihara Chemical Co., LTD., Kobe, Japan –200 g/L In example 2, the anolyte contains organic additives. In a typical operation of an apparatus provided herein, a portion of the anolyte is directed from the anode chamber to the cathode chamber via a fluidic conduit other than the separator. This anolyte to catholyte stream is important in maintaining the balance of the plating bath and is referred to as a cascade stream, while addition of anolyte to catholyte is referred to cascading. Thus, an anolyte containing plating additives is cascaded to the cathode chamber, where the plating additives improve electrodeposition of metals. The concentrations of additives in the anolyte are set, in many embodiments, to be approximately equal to or greater than those used in the catholyte. In a preferred embodiment having anolyte with an additive, the concentrations of the additives are set at a level so that after addition of the cascaded anolyte stream to the catholyte and addition of any silver-containing solution to the catholyte to maintain silver content, the net result is a concentration of additives at or below the target concentration of additives in the catholyte. Due to the use of the tin anode and its associated much lower oxidation potential than that of an inert anode, the presence of additives in the anolyte is generally not detrimental to the overall process.

If the concentration of the tin is lower and of acid is higher in the anolyte initially, based on what would be overall mass balance for the various system concentration and flows, initially in operation, the anolyte acidity will generally increase and the anolyte tin ion concentration will generally decrease. This is due in part to the higher mobility of protons compared to tin ions. Eventually a steady state will be reached.

Example 3

Tin: 230 g/L (as tin methanesulfonate)
Acid: 50 g/L (as methanesulfonic acid)
Silver: None
Additives: None Example 4

Tin: 50-150 g/L (as tin methanesulfonate)
Acid: 180-350 g/L (as methanesulfonic acid)
Silver: None
Additives: None Example 5

Tin: 70 g/L (as tin methanesulfonate)
Acid: 230 g/L (as methanesulfonic acid)
Silver: None
Additive:
Ishihara TS202-AD (additive): 40 g/L
Ishihara TS-SLG (Silver Complexer)-200 g/L In example 5 (as with the anolyte composition of example 2), when the additive is added in the anolyte feed, the additives are generally introduced at a concentration equal to or greater than those present in the catholyte so that they will be near the target additive level in the catholyte after dilution with addition of diluting solution of dissolved silver to the catholyte.

Composition of Anolyte Feed

The composition of the anolyte feed is typically higher in acid and lower in tin than the steady state anolyte concentrations. In many embodiments anolyte feed has tin concentration of about 70-120 g/L, and acid concentration of about 180 to 250 g/L (as MSA). This is due to the necessity of supply acid to the anolyte to allow for maintenance of the pH in the anode chamber below 2 (so that tin remains dissolved in anolyte) and makeup for the protons that are removed continuously during plating from the anode chamber to the cathode chamber due to selective electromigration through the separator. Protons have a significantly higher mobility relative to the heavy metal tin, which generally has a small, and sometime even negligible, ion mobility through the separator, depending on the specific properties of the separator. The rate of addition of anolyte feed (time averaged feed flow rate) depends and scales with the amount of metal being plated (charge per wafer and wafers per hour) in the plating operation. Typically, a controller configured to control anolyte feed dosings is controlled coulometrically and is capable of adjust anolyte feed flow in response to a predetermined number of Coulombs passed through the system, or the number of substrates processed, or after pre-determined time elapsed.

Composition of the Catholyte

In various examples—employing a plated metal composition of about 1-3% silver and about 98% tin—the catholyte may have the following composition at start up.

Silver—0.5 to 1.5 g/l silver ions
Tin—30-80 g/l tin ions

Acid—70-180 or more g/l acid (based on sulfuric acid or methane sulfonic acid). This high acid level provides a very high conductivity to facilitate plating and improves current distributions on the wafer.

Organic additives—grain refiners, noble metal complexers, brighteners, accelerators, suppressors, and/or levelers. Examples of suitable grain refiners include but are not limited to PEG, hydroxylated cellulose, gelatin, and peptone. Accelerators, suppressors, brighteners and levelers, are organic bath additives capable of selectively enhancing or suppressing rates of deposition of metal on different surfaces of the wafer features, thereby improving the uniformity of deposition.

Complexing agents, suitable for complexing silver include aromatic thiols or sulfide compounds including thiophenol, mercaptophenol, thiocresol, nitrothiophenol, thiosalicylic acid, aminothiophenol, benzenedithiophenol, mercaptopyridine. 4,4-thiodiphenol, 4,4-aminodiphenyl sulfide, thiobisthiophenol, 2,2-diaminodiphenyl disulfide, 2,2-dithiodibenzoic acid, ditolyl disulfide and 2,2-dipyridyl disulfide. These complexing agents may be used as silver complexers at low pH and are suitable for use in tin-silver plating baths (e.g., baths containing methanesulfonic acid).

Continuous Electroplating

In a preferred embodiment, a method for continuous electroplating, in which plating bath chemistry can be stable over prolonged periods of use is provided. Specifically, concentrations of the first metal, the second metal, and of protons in catholyte can be maintained, such that each does not fluctuate by more than about 20%, such as by more than about 10% over the period of at least about 0.2 bath charge turnovers, at least about 0.5 bath charge turnovers, at least about 2 bath charge turnovers, or at least about 10 bath charge turnovers. Further, except during startup transients, concentrations of the first metal and of protons in the anolyte can be maintained such that each does not fluctuate by more than about 20%, such as by more than about 10% over the period of at least about 0.2 bath charge turnovers, at least about 0.5 bath charge turnovers, at least about 2 bath charge turnovers, or at least about 10 bath charge turnovers. For example, in many embodiments, proton concentration in the catholyte does not fluctuate by more than about 10% over the period of at least about 0.2 bath charge turnovers, such as for a period of at least about 2 bath charge turnovers.

One exception to anolyte concentration consistency targets noted above will occur if, during the initial startup with a new bath, the tool is charged with anolyte having a substantially different concentration than that which the anolyte eventually will achieve after processing wafers via the system wide mass balance (the anolyte steady state values). One may decide to operate in this anolyte-transient fashion so as to minimize the complexity of having to produce and insert a unique solution composition for the anolyte chamber at startup. Typically the anolyte feed stream is relatively richer in acid (to allow for proton migration across the cell separator) and relatively poorer in tin compared to the anolyte steady state values. During plating, the anolyte is continuously reducing its acid concentration and increasing its tin concentration due to tin production from the active anode and preferential migration of protons through the separator. So, if one initially charges the anolyte with acid-rich steady state feed stream concentrations, some time must pass before the concentration in the anolyte will reach the tin rich steady state concentrations In some embodiments, alternatively one can charge the anode chamber with a solution of a tin-rich solution having a concentration that is different than the anolyte feed concentrations and corresponding to the steady state acid and tin target concentrations, thereby avoiding any transient anolyte behavior and influence of that transient anolyte on catholyte concentrations.

One (1.0) bath charge turnover corresponds to a state in which an electroplating tool has passed an amount of charge through the plating cell and the catholyte contained or circulated therein, such as to plate an amount of metal (e.g. tin) equal to the total amount of metal contained in the catholyte. In those embodiments, where the cathode chamber is fluidically connected to a reservoir containing catholyte, the catholyte encompasses both the electrolyte in the plating cell and in the reservoir (also referred to as the "plating bath"). To further clarify and illustrate this meaning, the following example is provided. If a plating tool contains a plating bath (reservoir) with a volume of 50 liters, and a plating cell which contains catholyte fluid held within the cell equal to 10 liters, the total catholyte volume is 50+10=60 L. If we further assume that the catholyte contains a first metal (tin) at a concentration of 70 g/L, then the total amount of tin contained in the tool's catholyte at all times will be 70 g/L×60 L=4200 g (and be substantially the same throughout the operation). When 4200 g of tin have been electroplated, the catholyte has undergone one bath charge turnover. The bath charge turnover concept allows one to maintain a consistent metric of plating bath use across baths and tools of different sizes and tools used for plating of various metals. It is noted that a bath charge turnover should not be confused with a bath fluidic turnover. The latter is the fractional number of times a bath has had is volume exchanged with new material (i.e. replenished and refreshed, or bleed and feed with new material).

In other words a single bath charge turnover corresponds to the state of tool operation wherein, starting with a "fresh bath", the amount of metal deposited since the fresh bath was installed equals the amount of metal contained in the in the catholyte of the tool (including both that in the cell and in any auxiliary baths). From a practical matter, in the case of tin silver plating, the difference between the amount of total metal plated vs. the amount of tin plated is relatively small. In other cases where the two metals' concentrations in the deposits are similar, bath charge turnover would correspond to the total amount of both metals extracted from catholyte to the substrate in comparison to the amount initially present in the catholyte. When the term "bath charge turnover" is applied to a system which employs bleed and feed (continuous addition and removal of electrolyte), it is understood that the atoms of metal being plated need not necessarily be the same atoms that were originally present in the bath (e.g., metal ions delivered from the feed stream can be plated)—however the amount of metal or metals plated should correspond to the amount of metal or metals originally present in the catholyte held in the cell and reservoir (if a catholyte-containing reservoir is part of a plating system.

The continuous method compares favorably to batch processes in that the plating bath does not need to be disposed of and the tool reconfigured for extremely long periods of use and in that concentrations of bath components can be maintained stable for long periods of use, such that many thousands of substrates (e.g., 2000 or more) can be processed sequentially under substantially the same bath concentration conditions without dumping the bath. Typically an inert anode bath operation can run no more than 2 bath charge turnovers before the bath is no longer useful (for example, due to the acid concentration reaching its upper limits, such that the total dissolved solids or the total organic additives have exceeded their solubility).

The provided design and operating parameters provide long lived plating baths (anolyte and catholyte) that maintain a steady state composition. The stable composition provides good wafer-to-wafer plating uniformity over many wafers without requiring a change of the plating bath. In some embodiments (e.g. with wafer substrates having only 1-10% exposed wafer open area), roughly 1-5% of the plating bath is replaced via bleed and feed over the course of one day. In other embodiments with substrates having large plating surface areas (e.g. 15-30% wafer open area), 10-20% of the plating bath is replaced via bleed and feed over the course of the day. In general, when a tool having an inert anode, and the tool having an active anode provided herein are compared, and when both tools use a bleed and feed method in order to maintain time constant bath properties, about 40% or less of the amount of expensive low-alpha soluble tin must be fed to the active anode tool described herein than in a tool that uses an inert anode. Thus, a tool operating according to embodiments provided herein is significantly more efficient and in this tool there is relatively less cost associated with preparing and transporting the electrolyte. There is also relatively smaller amounts of potentially high-value low alpha tin waste produced. This should further be compared to the situation encountered when using conventional batch processes which employ inert anodes. In some circumstances (depending on batch bath lifetimes) the current invention cost of operation is superior to inert anode batch operations. And inert anode-based processes can generate ever increasing concentrations of acid and oxygen and/or salt which cannot be easily removed, typically limiting the life of the plating bath to a couple "charge turnovers."

It should be pointed out that while all sources of low alpha tin are expensive, sources in which the tin is provided in a pre-formulated plating solution are particularly expensive. Put another way, generally the commercial cost per gram of low-alpha tin metal is much less than the cost of tin per gram in a low alpha tin ion solution. Therefore, it is desirable to use low alpha tin metal or oxide as a low alpha tin metal source. Particularly, the use of a tool that employs low alpha tin anodes appears to be particularly attractive due to the lower cost. However, there are additional benefits to using a tin anode system over a tin solution along with a dimensionally stable anode. The silver can also be recovered from the electrolyte and reconstituted into the silver ion feed solution (these electrolyte feed solutions are sometimes referred to as metal concentrates or, virgin makeup solutions, or "VMS").

Most (but not all) current processes for depositing tin-silver alloys employ batch processing with an inert anode. An inert anode is sometimes referred to as a dimensionally stable anode because it does not change shape during its useful life. It typically includes a surface coating of an inert material such as a rhodium-platinum alloy and takes the form of a screen or mesh. Unfortunately, acid and oxygen are generated at the dimensionally stable anode. Thus, the total free acid in the electrolyte continuously increases and small oxygen bubbles must be separated to avoid coating of the wafer surface and blocking plating (oxygen bubble defects). The inert anode can also oxidize the bath additive, complexers, and stannous ion to stannic ion as discussed above. Eventually the acid concentration becomes so great and the plating bath becomes so concentrated and degraded that it must be diluted and/or replaced. While a high acid concentration is desirable for many types of electrodeposition, changes in concentration result in changing wafer performance over the life of the bath which affects within die uniformity and within feature shape. Because the electrolyte composition varies over the life of the bath, wafer-to-wafer processing is not consistent. In a typical batch process, fresh electrolyte has an acid concentration of about 100 g/l methane sulfonic acid which increases over the life of the bath to about 250 to 300 g/l. Periodically, tin and silver anions are added to the bath but their anions are not consumed, so the acid concentration and concentrations of additive breakdown products continue to increase. A bath used in a conventional process is good for about 1.5 to 2 charge turnovers (this can be extended slightly with dilution at the end of life) before reaching an acid concentration of about 300 g/l, at which time it must be replaced.

The apparatus described herein has an intricate combination of fluidic features and an associated controller, which are configured to provide a continuous process with a stable bath chemistry. The apparatus is designed to operate with a separating structure, which is permeable to protons, water, and optionally, to tin ions during plating, where all three of these species flow from the anode chamber to the cathode chamber during plating. As it was mentioned above, silver ions substantially do not cross from catholyte to anolyte during plating. These properties of the separator cause a number of unique challenges for maintaining mass, volume, and pressure balance in the plating system. These challenges are addressed by providing fluidic features and an associated controller, coupled to the apparatus and configured to deliver an acid solution to the anode chamber from a source outside the anode chamber; deliver a solution comprising ions of the first metal (e.g., tin) to the anode chamber from a source outside the anode chamber; remove a portion of the catholyte from the cathode chamber; deliver ions of a second metal (e.g., silver) to the cathode chamber (via delivery of a solution comprising ions of the second metal and/or using an auxiliary anode comprising the second metal); and deliver anolyte from the anode chamber to the cathode chamber via a conduit that is different from the separation structure.

Tin, in the absence of strong complexing agents or anions (e.g. cyanides or oxalates), requires a strongly acidic environment (generally less than pH 2) to remain in solution. Tin is very soluble in acidic solutions of methanesulfonic acid (as tin methanesulfonate). One can consider use of high pH solutions, but in the presence of strong tin complexing agents the potential for tin deposition shifts further negative, making it increasingly difficult to plate without causing the electrolysis of water. Therefore, in many embodiments, a highly acidic tin solution is desirable. Silver is relatively soluble in methanesulfonic acid (but not significantly as a sulfate), and with the use of a silver complexing agent, the reduction potential of complexed silver can be brought to within about 0.3V of tin. However, being a large and heavy ion, tin's ionic mobility is about 15 times smaller than that of a proton in the electrolyte and generally 30-50 times smaller within a cationic membrane. Since it is desirable to have relatively high acidity in the anolyte to maintain tin solubility and the due to naturally higher proton mobility, the fractional ionic current carried by tin across the separator is generally small (about 20% or less) in many embodiments. Therefore, to maintain acidity and tin in solution in the anolyte, acid must be added to the anolyte. That acid carries most (in some cases almost all) of the ionic current across the separator, and this migration of protons (combined with electrochemical dissolution of the tin anode) results in a continuously increasing tin and decreasing acid concentration in the anolyte. To combat the tendency for the pH to rise in the anolyte, the tendency of tin to accumulate in the anolyte and not to transport to the catholyte and to prevent tin from precipitating out of solution in the anolyte, a high concentration acid anolyte feed is introduced together with periodic removal of a relatively low acid/high tin (in concentration) anolyte material before the precipitation occurs. The tin generated by the anode and dissolved in the anolyte is physically moved to the catholyte (to the cathode chamber of the cell or a reservoir) via a fluidic conduit other than the separator, where the fluidic conduit may be equipped with a pump. In other words, anolyte solution is directed from the anode chamber to the cathode chamber or to a catholyte-containing reservoir ("cascade" stream). This process maintains the balance and stability of the system and enables a continuous stable operation.

Among the various effects addressed by this cascading and bleed and feed operations are the following:

1. depletion of acid relative to tin ions from the anolyte 2. electroosmotic drag—The cations passing through the separator from anolyte to catholyte are coordinated with water molecules and drag some water with them, resulting in a depletion of water in the anode chamber. A continuous increase in concentration of anolyte and an unsustainable pressure difference could build up if electroosmotic drag is not addressed. It is noted that in many embodiments provided herein there is no net osmotic transfer of water in the opposite direction (from catholyte to anolyte), and in many embodiments ionic strength difference between anolyte and catholyte is not as great as to cause osmotic effects, while electroosmotic drag of water from anolyte to catholyte can be pronounced.

3. gradual increase in tin concentration in the anode and cathode chambers. Approximately 100% of the charge passed through the anode will go to producing tin ions (in the case of a consumable anode). Only 98% of the same charge passed through the cathode will plate tin ions. Depending on the operators' compositional target, about 2% of the charge through to the cathode will plate silver. This problem is not as significant when a silver anode is employed as a source of silver ions.

4. organic additives are consumed or broken down—levelers are typically consumed in the deposit and/or broken down. Accelerator and brighteners decompose and are gradually lost.

5. silver complexing agents need to be replenished. These typically contain thiols, sulfides, sulfonamides, mercaptans or other organic moieties that can become oxidized during normal operation.

Figure 2A:
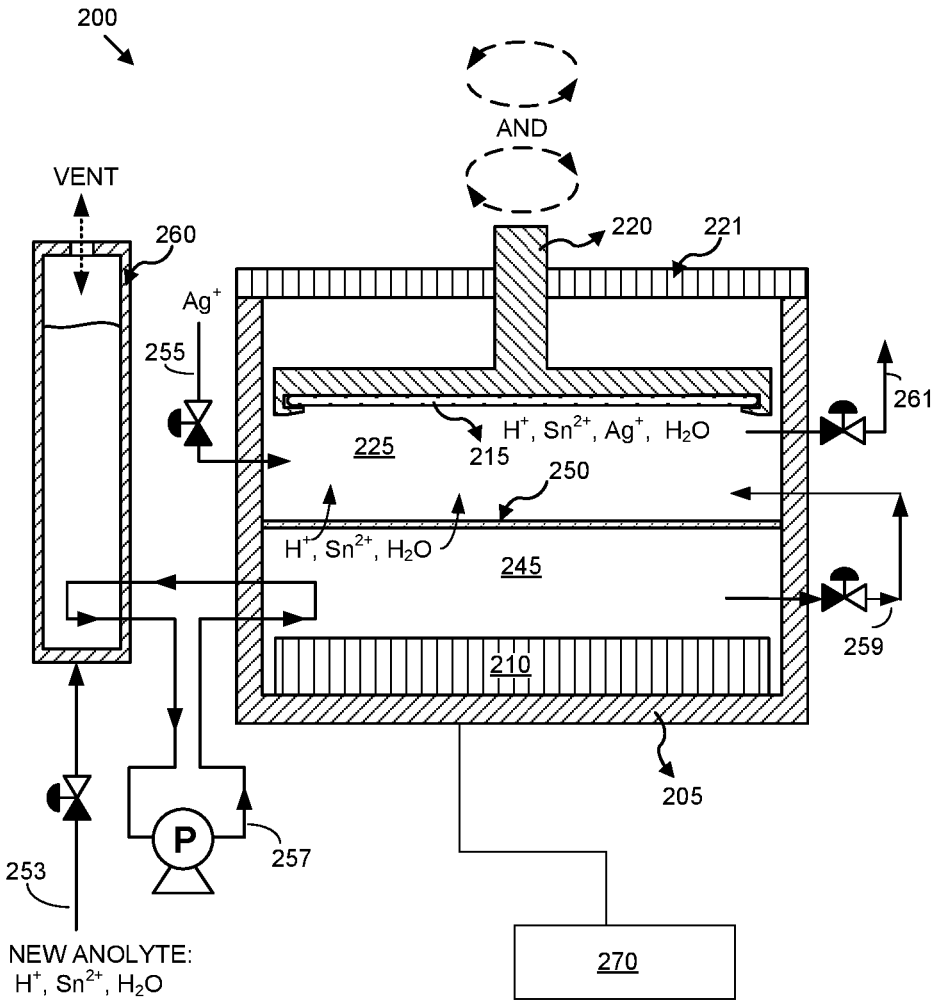
FIG. 2A is a diagrammatic cross-sectional view of an embodiment of an electroplating apparatus in accordance with the present invention.

An example of a suitable apparatus for plating in accordance with embodiments provided herein is illustrated in FIG. 2A. Generally the apparatus exemplified herein concerns various types of "fountain" plating apparatus, but the invention itself is not so limited. In such apparatus, the work piece to be plated (typically a semiconductor wafer in the examples presented herein) has a substantially horizontal orientation (which may in some cases vary by a few degrees from true horizontal) and rotates during plating with generally vertically upward electrolyte convection. One example of a fountain plating apparatus is the Sabre® Electroplating System produced by and available from Novellus Systems, Inc. of San Jose, Calif. Additionally, fountain electroplating systems are described in, e.g., U.S. Pat. No. 6,800,187 and US Patent Application Publication US 2010-0032310A1 filed Feb. 11, 2010, which are incorporated herein by reference in their entireties. It should be understood that some aspects of the invention may apply to other types of electroplating apparatus such as paddle plating apparatus including those developed and/or commercialized by IBM, Ebara Technologies, Inc., and Nexx Systems, Inc. Paddle plating apparatus generally hold the work piece in a vertical orientation during plating and may induce electrolyte convection by periodic movement of a "paddle" in the cell. Hybrid configuration can also be envisioned, which may be configured for rotating the wafer horizontally in a face down orientation with an agitator near the wafer's surface. In some embodiments an apparatus contains components, configured to improve electrolyte flow distribution in the proximity of the wafer substrate, such as those provided in the U.S. application Ser. No. 13/172,642 filed on Jun. 29, 2011 naming Mayer et al. as inventors and titled "Control of Electrolyte Hydrodynamics for Efficient Mass Transfer during Electroplating", which is herein incorporated by reference in its entirety.

Figure 2B:
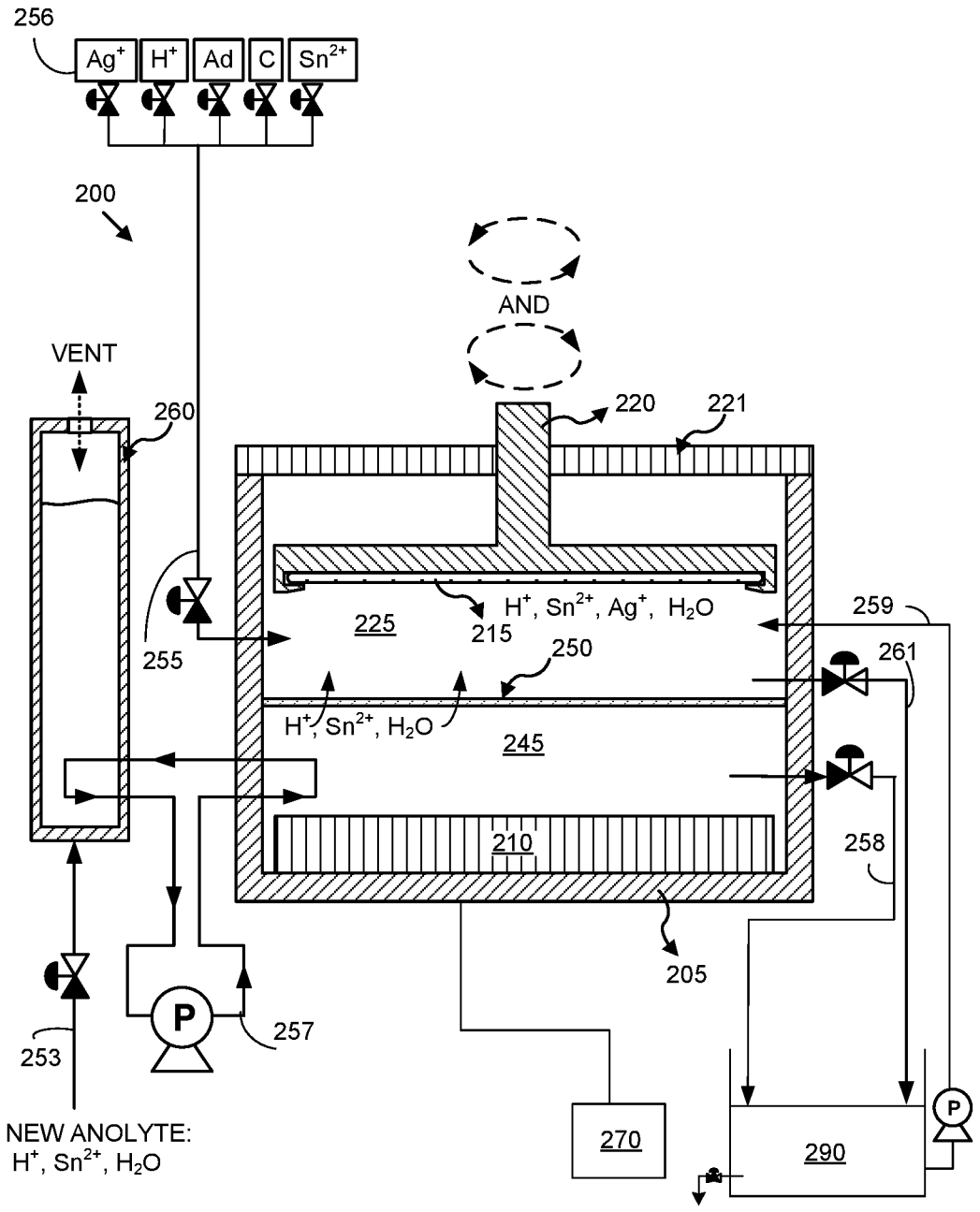
FIG. 2B is a diagrammatic cross-sectional view of another embodiment of an electroplating apparatus in accordance with the present invention.

FIGS. 2A and 2B show schematic cross sections of a suitable electroplating apparatus 200, containing plating cell 205, in accordance with two embodiments of the invention. The difference between the apparatuses depicted in FIGS. 2A and 2B is the presence of a reservoir 290 in the apparatus depicted in FIG. 2B, and in the associated arrangement of fluidic features. The illustrated apparatus is configured for plating silver and tin, but can be also used to plate other combinations of metals with different electrodeposition potentials. In the discussion of apparatuses below, tin, can be replaced with a "first metal" (less noble metal), and silver can be replaced with a "second metal" (more noble metal).

In the apparatus 200, an anode 210, which is a consumable tin anode, is typically located in a lower region of the plating cell 205. A semiconductor wafer 215 is positioned in catholyte retained in the catholyte chamber 225 and is rotated during plating by a wafer holder 220. Rotation can be bidirectional. In the depicted embodiment the plating cell 205 has a lid 221 over the cathode chamber. The semiconductor wafer is electrically connected to a power supply (not shown) and is negatively biased during electroplating, such that it serves as a cathode. The active tin anode is connected to the positive terminal of the power supply. A separator 250 which is at a minimum cationically conductive for protons and inhibits direct fluid flow transfer between the anolyte and catholyte chambers, is located between the anode and the wafer (the cathode) as it separates and defines an anode chamber 245 and a cathode chamber 225. The isolated anodic region of the plating cell is often referred to as a Separated Anode Chamber (SAC). An electroplating apparatus having a SAC is described in detail in U.S. Pat. No. 6,527,920 issued on Mar. 4, 2003 to Mayer et al., U.S. Pat. No. 6,890,416 issued on May 10, 2005 to Mayer et. al., and U.S. Pat. No. 6,821,407 issued Nov. 23, 2004 to Reid et al., which are herein incorporated by reference in their entireties.

Separator 250 allows selective cationic communication between the separated anode chamber and the cathode chamber, while preventing any particles generated at the anode from entering the proximity of the wafer and contaminating it. The separator, as mentioned, allows flow of protons, from anolyte to catholyte during plating. Further, the separator may allow passage of water from anolyte to catholyte, which moves along with the protons. In some embodiments, the separator is also permeable to tin ions during plating, where the tin ions will move from anolyte to catholyte, when potential difference is applied (but not in the absence of potential difference). The separator may also be useful in prohibiting anionic and non-ionic species such as bath additives from passing though the separator and being degraded at the anode surface, and as such, in some embodiments, the anolyte contained in the anode chamber remains substantially free of organic additive species (such as accelerators, levelers, suppressors, grain refiners, and silver complexers) present in the catholyte that are used to control within wafer, within die or within feature uniformity or various metrological properties.

The separator having these properties can include an ionomer, e.g., a cationic polyfluorinated polymer having sulphonate groups, such as the commercially available product made by DuPont de Nemours provided under the trade name Nafion. The ionomer can be mechanically reinforced, e.g., by incorporation of reinforcing fibers within the ionomer membrane, or externally by a mechanical construct, and can reside on a mechanically strong support such as. a solid material with drilled holes to create a reticulated structure, or a continuously sintered microporous material, e.g., a microporous sheet material such as Porex™.

It has been demonstrated that some cationic ionomer membranes, such as the sulfonated tetrafluorethylene based fluoropolymers like that developed in the late 1960's by Dupont under the tradename Nafion, effectively block essentially all transport of silver and stannous ions by diffusion. Data demonstrating Nafion's effectiveness was collected. Silver and tin ions are relatively large, which may cause steric hindrance in their movement through the membrane's hydrated pores. In one of the tests, on one side of the cationic membrane, silver complexing agent, silver ions, tin ions (both as methanesulfonate salts), MSA, and plating additive were present. On the other side of the membrane is a solution containing only MSA (no tin, acid, complexer, or additives). The solution on the tin and silver free side of the membrane was continuously stirred and samples were periodically withdrawn and measured by inductive coupled plasma (ICP) for even low level trace amounts of silver and tin ions. No potential difference was applied in this test. Chemical analysis for the presence of additive and complexer indicated that these species were not detected (minimum detection limit for these is estimated to be about 10% of that present in the initial solutions). Further, a nearly perfect inhibition of diffusive transport for the silver and tin metals and at least good suppression of the organic components transference, was observed. It has been also demonstrated that Nafion membrane, while blocking stannous ions transfer via a diffusion mechanism in the absence of potential difference, permits transfer of stannous ions via a migration mechanism during electroplating. This test was done by placing an inert anode in the tin and silver solution side of the membrane, and a platinum cathode in the initially acid-only side of the system, and measuring the change in acid and tin in both sides of the cell. The results show that about 10-15 percent of the current is carried by tin under the situation where the total ionic strength of the two side is equivalent but the tin concentration is 200 g/L and acid 50 g/L on the anolyte side.

Silver transport to the anolyte (which is present in the catholyte as a complex) can be limited by selecting appropriate silver complexes with large effective ionic radii. Complexing agents with strong binding energies and low free silver bath content are preferred because the thermal energy to break the complex bond is lacking and the concentration and diffusion of the relatively smaller free ion will be thereby limited. In general larger silver complexes will exhibit smaller bulk diffusion coefficients. But while high complexing strength materials are generally preferred, since silver deposition is a diffusion limited process, a balance must be considered. Smaller bulk diffusion coefficient will result in a lower diffusion limited deposition rate at the same bulk silver concentration and so high silver content is required to compensate, leading to no net benefit. In some embodiments, silver complexer with effective ionic radii between 6-20 Å and bulk diffusion coefficients between 2E-6 and 1E-7 $cm^2$/sec appear to be optimal.

As it was mentioned, the anolyte contains ions of tin and protons but is substantially free of silver ions. During plating, the current is carried through the separator by protons, thereby depleting the anolyte of acid. Further, water is typically carried with the protons through the separator during plating, thereby reducing the volume of anolyte. Stannous ion can also travel through the separator during plating in this embodiment (even though the separator may be impermeable to stannous ion in the absence of potential difference). These conditions can lead to precipitation of tin-containing species in the anolyte, in the absence of active fluidic control of the system (including the ability to replace removed protons and to remove increasing concentrations of tin such as tin to maintain tin concentration and acidity).

In the depicted embodiment, the apparatus includes the following fluidic features that are configured to maintain balance in the continuous plating system.

In the embodiment depicted in FIG. 2B, catholyte is circulated from a plating reservoir 290 to the cathode chamber 225 using a pump and is returned to the reservoir by gravity draining. Generally, the volume of the reservoir is greater than the volume of the cathode chamber. Between the reservoir and the catholyte chamber the circulating catholyte can undergo a number of treatments, including filtration with the use of filters (e.g., configured to remove particles) and or fluid contactors configured for removal of dissolved oxygen in circulating catholyte. Catholyte is periodically removed from the bath/catholyte via a drain line or overflow line in the reservoir. In some embodiments one reservoir services several cells and may be fluidically connected to cathode chambers of more than one cell (not shown). In the embodiment shown in FIG. 2A an apparatus which does not have a catholyte reservoir is shown.

The apparatus (in both embodiments shown in FIGS. 2A and 2B) contains an anolyte circulation loop 257, which is configured to circulate anolyte within and to and from the anode chamber. The anolyte circulation loop typically includes a pump configured to move the anolyte in the desired direction, and may optionally contain a filter for removing particles from circulating anolyte, and one or more reservoirs for storing anolyte. In the depicted embodiment the anolyte circulation loop includes a pressure regulator 260. The pressure regulator comprises a vertical column arranged to serve as a conduit through which the anolyte flows upward before spilling over a top of the vertical column, and wherein, in operation, the net height difference between the fluid level in the catholyte chamber 225 and the highest point of the fluid in the pressure regulator creates a vertical column that provides a positive pressure head above atmospheric pressure on the separator membrane 250 and maintains a substantially constant pressure in the anode chamber. In the depicted embodiment the anolyte is configured to flow from the anode chamber to the pressure regulator before returning to the anode chamber. The pressure regulator in some embodiments has a central tube with a top surface through which fluid enters the pressure regulator containment vessel, and then spills over as a fountain into the pressure regulator reservoir region below. This allows the height of the central tube relative to the catholyte fluid height to define and maintain the net positive pressure in the chamber at all times, independent of the exact amount of fluid actually contained in the combined anode chamber and pressure regulator system. The pressure regulator 260 is described in more detail with respect to FIG. 5 below.

The apparatus further contains fluidic features configured to add acid and stannous ion to the anolyte. Addition of acid and stannous ion can be accomplished at any desired point—directly to the anode chamber, to the lines of the anolyte circulation loop, or to the pressure regulator, as depicted in FIG. 2A, which shows line 253 delivering the fresh anolyte solution which comprises acid, stannous ion, and water. The apparatus may also include a source or several sources containing acid and stannous ion solution outside the anode chamber, and fluidically connected to the anode chamber. The acid and stannous ion solutions can be delivered in separate streams, or can be pre-mixed before delivery to the anolyte. Further, in some embodiments, a separate line for delivering water (without acid or stannous ion) to anolyte can fluidically connect a water source to the anolyte.

The apparatus further includes a fluidic conduit 259, configured for delivering anolyte containing acid and stannous ion from the anode chamber to the cathode chamber or to the reservoir 290 containing surplus catholyte (in the embodiment of FIG. 2B). In some cases there is a pump associated with this conduit and configured to pump anolyte to the catholyte chamber. In other cases, the transfer is made to a reservoir that is located at a lower level than the cell and fluid simply flows downhill by gravity into the reservoir 290 as illustrated by 258. In other embodiments 258 can be a fluid line or any other fluidic conduit configured to deliver anolyte to the reservoir 290. From the reservoir 290 the fluid can be directed to the cathode chamber via a conduit 259. This anolyte to catholyte "cascade" stream (with or without the use of reservoir) is significant for replenishing the catholyte with the stannous ion, for removing fluid from the anolyte system and thereby for making room for fresh, acid-rich replenishment chemistry in the anode chamber. In some embodiments, the cascade stream transference occurs passively via an overflow conduit in the pressure regulator chamber. When a volume of introduced feed high-acid low-tin material is introduced to the anolyte system, the low-acid/high-tin electrolyte in the anode chamber overflows into the conduit and into the plating reservoir 290, because the total volume in the anolyte system, and therefore level in the pressure regulator, exceeds the level of the overflow conduit inlet in the pressure regulator. In some embodiments, at least some stannous ion moves to the cathode chamber both through the separator during plating and via the cascade fluidic conduit.

The cathode chamber of the apparatus, depicted in the embodiments shown in FIGS. 2A and 2B, includes an inlet configured for receiving a solution containing silver ions, and an associated fluidic conduit 255 connecting a source of silver ions to the cathode chamber. In some embodiments, e.g., as shown in FIG. 2B, the catholyte addition system 255 includes an inlet distribution manifold 256 allowing for each of the chemical in the bath to be added to the catholyte. Typically silver, silver complexer, and organic additive are added to the catholyte/bath in an amount necessary to maintain their concentration at a desired target, and includes quantities of electrolyte components required to replace chemistry removed by the bleed operation and to make up for dilution by incoming silver-free and additive-free (in some embodiments) cascade flow, as well as any dosing associated with charge based consumption or degradation. While in some embodiments one does not need to dose acid or tin into the catholyte, enabling one to do so would allow for better operational control. Additions to the catholyte of the components are typically controlled based on deviation from target concentrations derived from metrology based feedback data, and the quantities of tin and acid required for these corrections are relatively small (i.e. they are minor correction and are materially and volumetrically small with respect to the major source by which these materials are added to the system, the anolyte feed and the anode). Thus, in some embodiments (regardless of the presence of the reservoir), the apparatus further includes fluidic features configured for adding a number of plating additives (such as grain refiners, accelerators and levelers) and/or complexing agent to the catholyte from a combined single source or from separate sources. In some embodiments the silver and a complexer are added from a single source (i.e., complexed silver ion is added). Importantly, in the depicted embodiment of FIG. 2A, it is not necessary to separately dose stannous ion to the catholyte, as this function is performed by the cascade (anolyte-to-catholyte) stream, and, to some degree, by the separator which may allow for some stannous ion transport. But in alternative embodiments, a separate source of stannous ion and an associated fluidic conduit may be connected to the cathode chamber and may be configured to add stannous ion solution for optimally tight process control of the tin catholyte concentration. Further, in the depicted embodiment, it is not necessary to add acid solution to the catholyte (as this is accomplished through the separator and by the cascade stream). In other embodiments, a source of acid and an associated fluidic conduit may be connected to the cathode chamber and may be configured to add acid solution to the catholyte for optimally tight process control of the acid catholyte concentration.

Further, the apparatus includes an outlet in the cathode chamber and associated fluidic features 261, configured to remove a portion of the catholyte from the cathode chamber. This stream is referred to as a "bleed" stream and typically contains silver ions, tin ions, acid, complexer and additives (such as grain refiners, brighteners, suppressors, accelerator and leveler). This stream is significant for maintaining overall mass and volume balance of the plating cell. In the embodiment depicted in FIG. 2A, the catholyte bleed 261 is discarded or is directed for regeneration of metals, as will be discussed in more detail with reference to FIG. 4. In the embodiment depicted in FIG. 2B, the catholyte from the cathode chamber is directed to the reservoir 290 via a conduit 261. The reservoir 290 is configured to drain some of electrolyte contained in the reservoir. Importantly, in the depicted embodiment the apparatus does not need to be configured to bleed anolyte (though the anolyte is cascaded to the catholyte), and catholyte bleed is sufficient for maintaining balance. In alternative embodiments, the apparatus may include a port and associated fluidic features configured for removing (bleeding) the anolyte from the apparatus (e.g., from the anode chamber or from the anolyte recirculation loop).

Fluidic features, referred to herein, may include but are not limited to fluid conduits (including lines and weirs), fluid inlets, fluid outlets, valves, level sensors and flow meters. As can be appreciated, any of the valves may include manual valves, air controlled valves, needle valves, electronically controlled valves, bleed valves and/or any other suitable type of valve.

A controller 270 is coupled to the apparatus and is configured to control all aspects of plating including parameters of feeding anolyte and catholyte, bleeding the catholyte, delivering anolyte to catholyte, etc. Specifically the controller is configured to monitor and control parameters (e.g. current, charge passed, bath levels, flow rates, and timing of dosing) related to need for addition of acid to anolyte, stannous ions to anolyte, water to anolyte, silver ions to catholyte, additive to the catholyte, complexer to the catholyte, delivery of anolyte to catholyte, and of bleeding (removal) of catholyte.

The controller can be configured for coulometric control of the plating process. For example, bleed-and-feed and cascading can be controlled, based on the amount of Coulombs passed through the system. In specific examples, dosing of acid, and stannous ion to anolyte, dosing of silver to catholyte, cascading of anolyte to catholyte, and bleed from the catholyte can be initiated after a pre-determined number of Coulombs passed through the system. In some embodiments, these are controlled, in response to predetermined time that has elapsed, or in response to the number of substrates processed. In some embodiments, dosing of water to compensate for evaporation is made periodically (feed forward time based) and/or in a feedback mode based on changes in measured bath volume.

In some embodiments, the controller is also configured to adjust parameters of the system (such as flow rates in the mentioned streams, and timing of dosing) in response to feedback signals received from the system. For example, concentrations of plating bath components can be monitored in anolyte and/or catholyte using a variety of sensors and titrations (e.g., pH sensors, voltammetry, acid or chemical titrations, spectrophotometric sensors, conductivity sensors, density sensors, etc.). In some embodiments the concentrations of electrolyte components are determined externally using a separate monitoring system, which reports them to the controller. In other embodiments raw information collected from the system is communicated to the controller which conducts concentration determinations from the raw data. In both cases the controller is configured to adjust dosing parameters in response to these signals and/or concentrations such as to maintain homeostasis in the system. Further, in some embodiments, volume sensors, fluid level sensors, and pressure sensors may be employed to provide feedback to the controller.

Two illustrative examples of a balance of catholyte and anolyte suitable for a system, depicted in FIG. 2A or FIG. 2B are provided below.

Balance Example 1

Catholyte:

Catholyte composition: 70 g/L $Sn^{+2}$ as a salt of methanesulfonic acid;

180 g/L methanesulfonic acid;

0.65 g/L $Ag^{+}$;

40 mL/L—TS-202AD grain refiner available from Ishihara, Japan;

205 mL/L TS-SLG silver complexer available from Ishihara, Japan.

Amount plated onto wafer per day: 494 Ahr/day 1079 g/day of tin;

27.7 kg/day of silver 197.6 ml/day TS-202 Electrolytically Consumed

Catholyte Additions:

1. 3.4 L/day of silver concentrate containing 10.6 g/L $Ag^{+}$ (35.6 g) and 2490 L/day of TS-SLG complexer from a source outside the plating cell; Note that the concentration of TS-SLG is 732 g/L in this stream, but this is not a measure of grams of the complexer compound in the stream. Rather, this is the equivalent amount of a dilute-water-solution of the compound that is supplied by a vendor, used for TS-SLG bath control, that is in the silver concentrate. The same applies to other examples, in which TS-SLG is employed, provided herein. It is noted that no addition of tin solution is made from outside sources to the catholyte in this case.
2. 685 mL/Day of the TS-202AD additive from a source outside the plating cell;
3. 8.4 L/day of anolyte from the anode chamber via a cascade stream composed of 230 g/L of stannous ion (1.93 kg/day) and 50 g/L of methanesulfonic acid (420 g/day).
4. Through the separator from the anode chamber: 3.6 g/Ahr of MSA acid equivalent pass equal to 1.77 kg/day, as well as some stannous ion (amount depends on membrane exact properties).

Catholyte Bleed:

Catholyte containing stannous ion, silver ion, methanesulfonic acid, the TS-202 grain refiner, and TS-SLG silver complexer is bled as necessary.

Anolyte:

Amount of tin dissolved from the tin anode into anolyte per day: 494 Ahr/day, 2.21 g/Ahr, 1.1 Kg/day of tin;

Anolyte Additions:

1. 3.3 L/day of water from a source outside the cell;
2. 2.8 L/Day of tin concentrate containing 300 g/L of stannous ion (840 g), and 30 g/L of methanesulfonic acid (84 g) from a source outside the cell; and
3. 2.2 L/day of acid concentrate containing 946 g/L of methanesulfonic acid (2.2 kg) from a source outside the cell.

If one were to plate a larger amount of material (e.g. 2 times than shown above) in a day and wanted to use a catholyte and anolyte having concentrations as above, then one can increase the flow rates of each streams proportionately and the system will remain in balance. If one wishes to use different catholyte and/or anolyte concentrations, a system-wide mass balance is calculated to determine appropriate suitable inlet and outlet mass and volumetric flow rate.

Balance Example 2

Plating was performed in an apparatus having two plating cells and one bath (reservoir). Tin-silver having 2.5% of silver by weight was plated at a deposition rate of 3.8 micrometers a minute, to a thickness of about 100 micrometers. Open area on the substrate was 20% and plating diameter on the substrate was 296.5 mm. The amount of charge passed through the system per wafer was 16365 Col/wafer. The maximum output was 3.5 wafers/hour with 84 wafers plated per day.

Catholyte/bath (input):

Volume: 50 L

Catholyte composition: 70 g/L $Sn^{+2}$ as a salt of methanesulfonic acid;

180 g/L methanesulfonic acid;

0.65 g/L $Ag^{+}$;

40 mL/L—TS-202AD grain refiner available from Ishihara, Japan;

205 g/L TS-SLG silver complexer available from Ishihara, Japan.

Amount plated onto wafer per day:

833 g/day of tin (2.18 g/AmpHr);

21.3 g/day of silver (0.056 g/AmpHr)

152.5 ml/day of TS-202 additive electrolytically consumed (0.4 ml/AmpHr)

Catholyte Additions:

1. 2.6 L/day (0.0068 g/AmpHr) of silver concentrate containing 9.4 g/L $Ag^{+}$ (27.5 g/day, 0.072 g/AmpHr) and 659.1 g/L of TS-SLG complexer (1922 g/day, 5.041 g/AmpHr) from a source outside the plating cell. Note also that no addition of tin and acid solution are made from outside sources to the catholyte in this case. A total volume of 2.9 L/day (0.08 L/AmpHr) is fed to catholyte from outside sources.
2. 528 mL/day (1.386 mL/AmpHr) of 181.2 mL/L of the TS-202AD additive from a source outside the plating cell;
3. 6.5 L/day (17 ml/AmpHr) of anolyte from the anode chamber via a cascade stream composed of 230 g/L of stannous ion (1.49 kg/day, 4 g/AmpHr) and 50 g/L of methanesulfonic acid (324 g/day, 1 g/AmpHr).
4. Through the separator from the anode chamber: 3.6 g/Ahr of MSA acid equivalent to 1.37 kg/day.

Catholyte bleed: 18.8% day, 9.4 L/day, 0.0246 L/AmpHr;

Composition of catholyte bleed, where the first value refers to concentration:

Stannous ion: 70 g/L, 658 g/day, 1.725 g/AmpHr;

Acid: 180 g/L; 1691 g/day, 4.436 g/AmpHr;

Silver ion: 0.65 g/L; 6.1 g/day; 0.016 g/AmpHr;

SLG complexer: 204.6 g/L; 1922 g/day; 5.041 g/AmpHr;

Grain refiner additive: 40 ml/L; 376 ml/day; 0.986 mL/AmpHr

Anolyte composition (input):

Stannous ion concentration: 230 g/L;

Methanesulfonic acid concentration: 50 g/L;

Amount of tin dissolved from the tin anode into anolyte per day: 2.21 g/Ahr, 844.3 g/day of tin;

Anolyte Additions:

1. 2.09 L/day (0.0055 L/AmpHr) of deionized water from a source outside the cell;
2. 3.05 L/Day (0.008 L/AmpHr) of tin concentrate from a source outside of the cell; and
3. 1.33 L/day of acid concentrate containing methanesulfonic acid from a source outside the cell.

The concentration of stannous ion in anolyte feed is 99.7 g/L, supplied at 646 g/day (1.694 g/AmpHr). The concentration of methanesulfonic acid is 261 g/L, supplied at 1691 g/day (4.436 g/AmpHr).

The apparatus, such as described in FIGS. 2A and 2B provides considerable cost savings as compared to conventional apparatuses having inert anodes operated to maintain uniform chemical concentrations. For example, consumption of tin is reduced by about 45-60% in the described apparatus as compared to the systems with inert anode.

Figure 3:
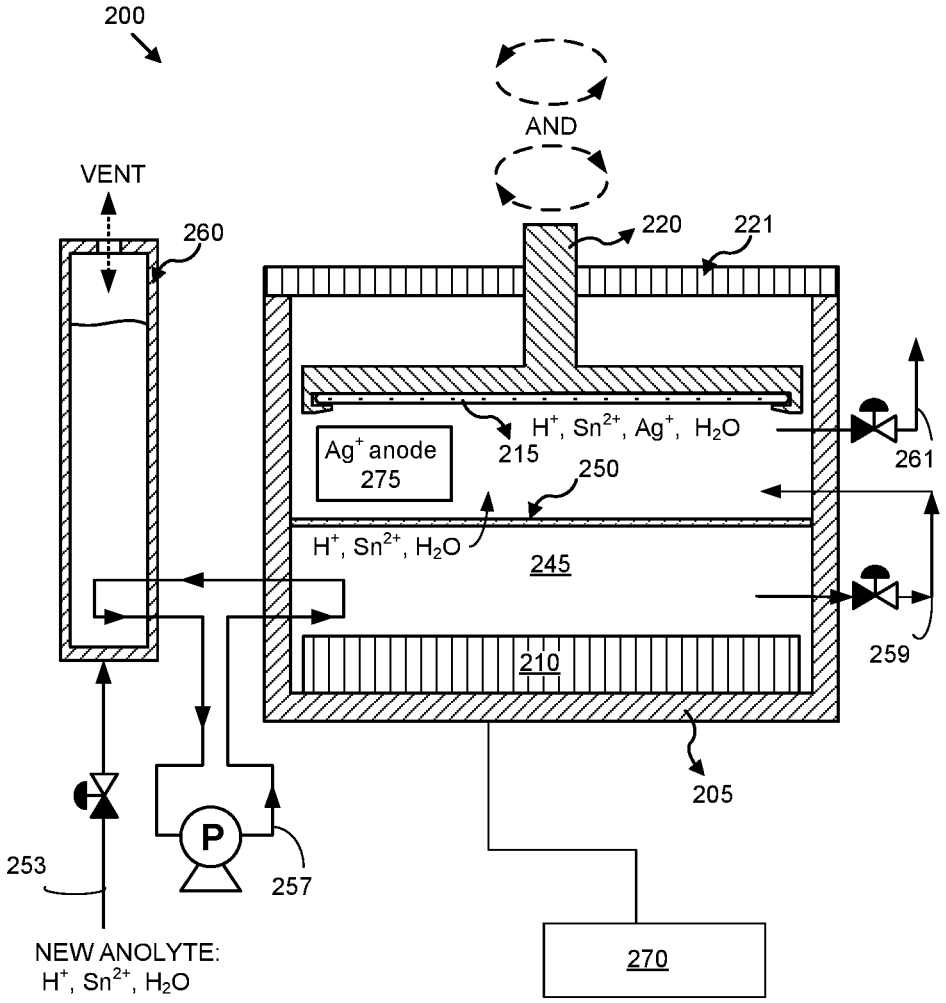
FIG. 3 is a diagrammatic cross-sectional view of another embodiment of an electroplating apparatus in accordance with the present invention.

FIG. 3 depicts a plating apparatus in accordance with another embodiment. In the depicted implementation all of the apparatus features are the same as in the apparatus shown in FIG. 2A, except that silver is provided to the catholyte not from a source of a silver ion solution, but by an auxiliary silver anode 275. This anode contains silver metal which is electrochemically dissolved during plating and thus becomes a source of silver ions for the catholyte. The silver anode is electrically connected to the power supply and is coupled to the wafer cathode. The silver anode should be positioned and configured such that the silver ions produced by its dissolution do not come into contact with the tin anode 210 or solution in the anolyte chamber 245. For example the silver anode can be positioned within the cathode chamber, or in a separate chamber in fluidic communication with cathodic chamber and the wafer, configured such that silver ions produced by the silver anode can flow to the catholyte but not to the anolyte. In some embodiments there is a membrane located between the silver anode and the substrate, where the membrane allows for ionic communication between the silver anode and the catholyte but prevents particles that can be generated at the silver anode from being transferred to catholyte.

In some embodiments, an apparatus which has a combination of features shown in FIGS. 2 and 3, is provided. Specifically, such apparatus includes both a silver anode and a source of silver ions in solution, where both are configured for delivering silver ions to catholyte.

In many embodiments the spent electrolyte (e.g., catholyte from the bleed stream, 261 or the catholyte drained from the reservoir 290) is not discarded but at least a portion thereof is regenerated and is reused in the plating apparatus. The regeneration process removes the more noble metal from the spend electrolyte (e.g. silver). In other cases the additive and acid concentrations are reduced or removed. A system configured for regenerating tin and/or silver to form solutions that are suitable for reintroduction to the electrolyte, can be physically coupled to the plating apparatus and may be fluidically connected with electrolyte (e.g. regenerated electrolyte can be directed into the anolyte feed stream). In other embodiments, the regeneration system may be separate from the plating apparatus and the regeneration apparatus can produce a regeneration feed stock (e.g. manufactured remotely feed back to the tool, such as delivered and stored in containers which can be then placed onto the tool or a bulk chemical deliver system connected to the tool). The regeneration system typically includes a station configured for receiving spent electrolyte (e.g. catholyte bleed stream) and separating silver from the tin solution. The regeneration system can further include a station configured for preparing tin and silver solutions that are suitable for reuse in the plating apparatus.

Figure 4:
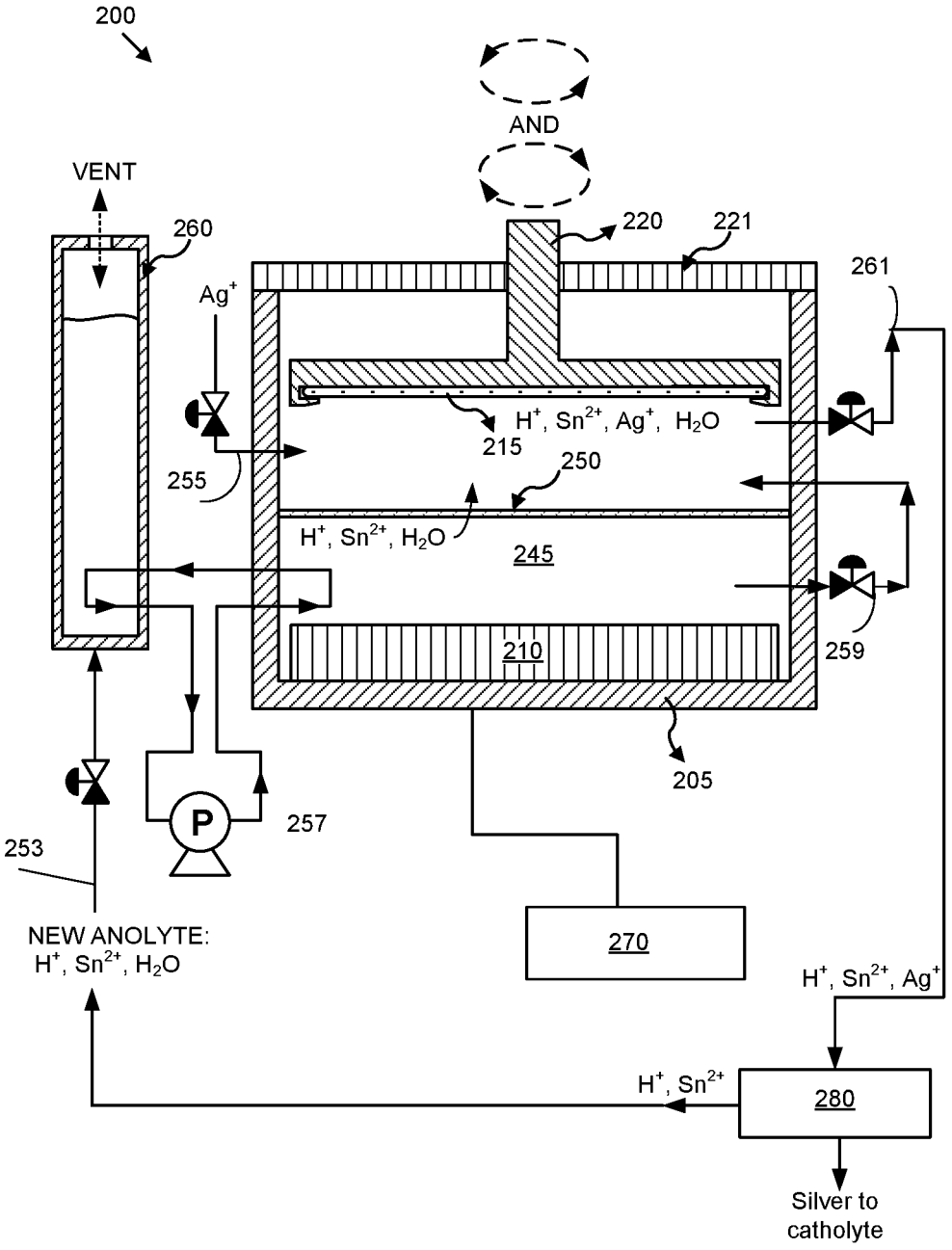
FIG. 4 is a diagrammatic cross-sectional view of another embodiment of an electroplating apparatus in accordance with the present invention.

One of the embodiments of an apparatus having a regeneration system for tin is shown in FIG. 4. The apparatus has all the features shown in FIG. 2A but additionally has a regeneration system 280, which is configured to receive catholyte from the catholyte bleed stream. The catholyte comprises acid, silver and stannous ions, and may additionally contain organic plating additives and complexing agents. In the regeneration system, silver is separated from the rest of the solution in the electrowinning separation station. Electrowinning station typically contains a chamber for housing the solution, and a cathode coupled to a power supply and configured to deposit silver under potential that is not sufficient to deposit tin. Because of the difference in electrodeposition potentials of tin and silver, silver can be deposited from solution onto a cathode electrochemically in an electrowinning station under controlled potential conditions, that would not allow deposition of tin (e.g. plating at a cathodic potential that is about 300 mV negative of the silver deposition potential and about 200 mV or more anodic of the tin plating solution). The electrowinning station's potential can be controlled by using a pure silver metal reference electrode to maintain the cathodic potential on the electrowinning cathode in the appropriate non-tin plating range. The anode counter electrode of the electrowinning system can be an inert anode (which will generate a small amount of acid and oxygen corresponding to the amount of silver removed), or a tin anode behind and in a cell separator (e.g. cationic membrane). After the silver is removed from solution, the resulting silver-free solution (comprising acid, stannous ions, and, optionally, unless otherwise removed, organic additives and the complexer) is delivered back to the anolyte via a fluidic conduit connecting the regeneration system and the anolyte. Optionally, the solution may further be conditioned before being reintroduced to anolyte, e.g., via addition of acid concentrate, additional tin concentrate, via filtration to remove particulate material, via carbon filtration to remove organic additives, etc. The regenerated tin solution may be added to anolyte at various points, e.g., directly to the anode chamber, to the anolyte recirculation loop, to the anolyte feed stock solution, etc. The silver metal cathodes obtained by electrowinning can be separately solubilized (e.g. by removing the cathode and dissolving the metal as an anode into a methane sulphonic acid solution with a cationic barrier between the anode and the hydrogen evolving cathode), and ions of silver so produced can be directed to catholyte. In some embodiments, an auxiliary silver anode can be made from electrowinned silver and used as a source of silver ions, and/or the silver metal can be chemically dissolved to form a solution of silver salt which may be fed to catholyte.

In an alternative silver extraction process, a portion of catholyte (typically equal to about the volume of catholyte additions) is removed from the spent solution (e.g., cathode chamber or reservoir bleed stream) and disposed of. The remaining portion of the spent solution is contacted with tin metal having large surface area. For example, the solution can be passed through a reaction vessel containing high surface are tin metal or tin metal bed (fixed or fluidized bed of metal particles, spheres, etc.), whereby the silver is displaced with tin by the process of electrolyte displacement.

$$2Ag^{+}+Sn \rightarrow 2Ag\ (\text{extracted})+Sn^{+2}$$

The tin metal in the extraction vessel is typically low alpha tin metal, so that the solution created maintains its low alpha properties. The fluid may be passed once or may pass multiple times through the bed of tin in the silver extraction vessel until the extraction process is complete. This displacement reaction process is the same one we purposely avoid in the cell (silver is made not to contact the tin anode) so that silver is not removed from the catholyte and is present to be deposited on the wafer. But here it is used to regenerate silver-free solution that is introduced into the silver free anolyte chamber, and silver is added back into the system in the catholyte.

The apparatuses described in FIGS. 2A, 2B-4 may contain a number of additional elements, which were not shown to preserve clarity. Such plating cells may include one or more additional features including field shaping elements and auxiliary cathodes. Such features are exemplified in U.S. patent application Ser. No. 12/481,503, filed Jun. 9, 2009, titled, "Method and Apparatus for Electroplating," naming Steven T. Mayer, et. al. as inventors, which is hereby incorporated by reference herein in its entirety. In some embodiments, the apparatus includes a "high resistance virtual anode" or flow shaping plate positioned in the cathode chamber proximate the work piece. This structure is described in various patents and patent applications including U.S. patent application Ser. No. 12/291,356 (Publication number US-2010-0032310), filed Nov. 7, 2008 [NOVLP299], and U.S. Provisional Patent Application No. 61/374,911, filed Aug. 18, 2010 [NOVLP367P] which are incorporated herein by reference for all purposes. The flow shaping plate is an ionically resistive plate having numerous small non-communicating holes passing therethrough. In some embodiments, the holes near the wafer center are oriented perpendicular to the work piece surface and the holes outward form the center are oriented at a non-orthogonal angle with respect to the work piece surface. In other specific embodiments, the flow shaping plate is shaped and configured to be positioned adjacent to the substrate in the cathode chamber and having a flat surface that is adapted to be substantially parallel to and separated from a plating face of the substrate by a gap of about 5 millimeters or less during electroplating. In some embodiments a flow restrictor and diverter on the substrate-facing surface redirects flow of electrolyte passing upwards towards the wafer and through the flow shaping plate and redirects the flow parallel to the wafer surface, confining the flow in a cavity between the wafer, the wafer holder, and the flow restrictor/diverter out of chamber through an open slot of the diverter. In other embodiments, fluid is injected parallel into the flow-restricted space between the wafer, the wafer holder, the flow shaping plate, the flow restrictor/diverter and out of wafer/flow shaping-plate cavity through an open slot of the diverter. These designs create wafer cross flow, and when coupled with wafer rotation, create a stochastic cross flow pattern across the feature over a period of time.

As it was mentioned, in some embodiments the anode chamber is coupled to a pressure regulator which is capable of equalizing the pressure in the anode chamber with atmospheric pressure. Such pressure-regulating mechanism is described in detail in U.S. application Ser. No. 13/051,822 titled "ELECTROLYTE LOOP FOR PRESSURE REGULATION FOR SEPARATED ANODE CHAMBER OF ELECTROPLATING SYSTEM" filed on Mar. 18, 2011 and naming Rash et al. as inventors, which is incorporated herein by reference in its entirety and for all purposes.

Figure 5:
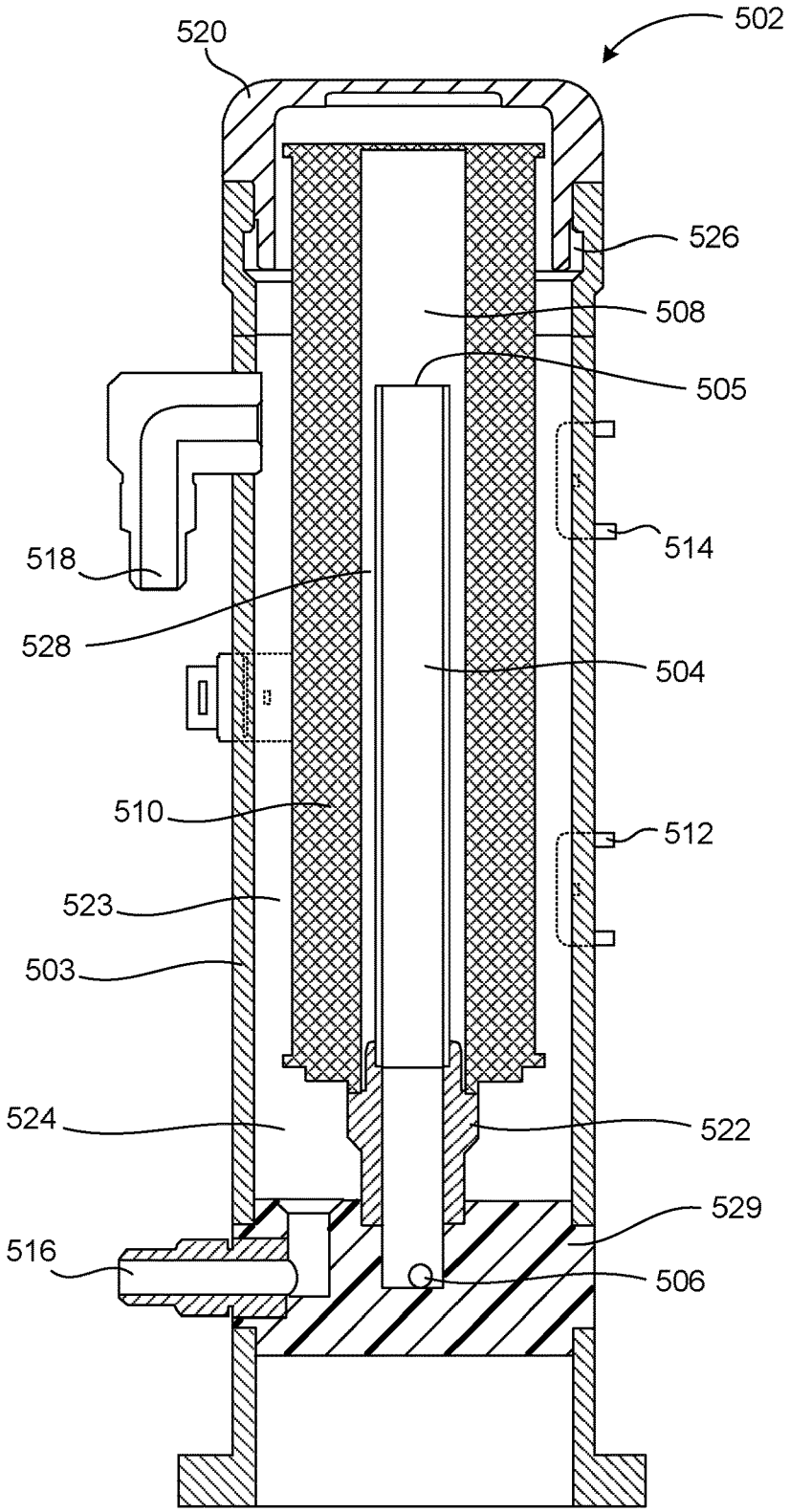
FIG. 5 is a diagrammatic cross-sectional view of a pressure controlling device for controlling pressure in the anolyte chamber.

FIG. 5 is a cross-sectional depiction of a pressure regulation device suitable for some implementations of the anolyte circulation loop systems described herein. In FIG. 5, the pressure regulator is depicted as item 502 having a housing 503 and a cap 520, which together define an outer structure of the regulator. The cap and housing may be attached by various mechanisms such threads, bonding, etc.

In operation, anolyte from a separated anode chamber such as chamber 245 shown in FIG. 2A is pushed into device 502 via one or more inlets 506 at the base of a center column 504. In some embodiments, there are several anode chambers serviced by one pressure regulator. In various embodiments, there is a separate entry port (like port 506) for each of the various anode chambers serviced by pressure regulator 502. In FIG. 5, only one such entry port is depicted. In the depicted embodiment, column 504 is mounted to the regulator 502 via a stem 522 embedded in a solid structural piece in the interior of housing 503.

The electrolyte pushed into center column 504 flows upward to a top 505 of column 504, where it spills over into an annular gap 528 and comes into contact with a filter 510. In various embodiments, gap 528 is relatively small to facilitate efficient filtering. As an example, gap 528 may be about 0.1 to 0.3 inches wide. Note that filter 510 is sealed to column 504 at, for example, the base of filter 510. An o-ring may be employed for this purpose. Note also that the depicted design includes an interstitial space 508 directly above the top 505 of column 504. This provides room for accommodating transient electrolyte surges out of column 504.

The pressure head of electrolyte in column 504 is responsible for maintaining a constant pressure within the separated anode chambers of the plating cells serviced by pressure regulator 502. Effectively, it is the height of central column 504 (at least the height above the electrolyte in the plating cell(s)) that dictates the pressure experienced by the electrolyte in the separated anode chambers. Of course, the pressure within these anode chambers is also influenced by the pump which drives recirculation of electrolyte from pressure regulator 502 and into the separated anode chambers.

The electrolyte flowing out of the top of column 504 encounters filter 510, as mentioned. The filter is preferably configured to remove any bubbles or particles of a certain size from the electrolyte flowing up through and out of column 504. The filter may include various pleats or other structures designed to provide a high surface area for greater contact with the electrolyte and more effective filtering. The pleats or other high surface area structure may occupy a void region within housing 503. Electrolyte passing through filter 510 will enter into a void region 523 between housing 503 and the outside of filter 510. The fluid in this region will flow down into an accumulator 524, where it may reside temporarily as it is drawn out of regulator 502.

Specifically, in the depicted embodiment, the electrolyte passing through filter 510 is drawn out of pressure regulator 502 through an exit port 516. An exit port such as port 516 is connected to a pump which draws out the electrolyte and forces recirculation through the separated anode chamber(s).

It may be desirable for filtered electrolyte temporarily accumulating within pressure regulating device 502 to maintain a certain height in region 523. To this end, the depicted device includes level sensors 512 and 514. In certain embodiments, the system is operated under the influence of a controller such that the liquid in region 523 remains at a level between sensors 512 and 514. If the electrolyte drops below level 512, the system is in danger of having the pump run dry, a condition which could cause serious damage to the pump. Therefore, if a controller senses that the electrolyte is dropping below level 512, appropriate steps may be taken to counteract this dangerous condition. For example, the controller may direct that additional make up solution or DI water be provided into the anolyte recirculation loop.

If, on the other hand, the electrolyte rises to a level above that sensed by sensor 514, the controller may take steps to reduce the amount of recirculating anolyte by, optionally, draining a certain amount of electrolyte from the recirculation loop. This could be accomplished by, for example, directing an associated aspirators to remove electrolyte from the open flow loop. Note that pressure regulator 502 is outfitted with a separate overflow outlet 518 which will allow excess electrolyte to drain out of the pressure regulator and into a reservoir holding the plating bath. This outlet may serve as an alternative passive means of transfer from the anolyte to the catholyte as part of the cascade process. As mentioned, such reservoir (the plating bath) may provide electrolyte directly to a cathode chamber of the plating cells. Also, as mentioned, a conduit connected to exit port 518 may provide an opening to atmospheric pressure such as via connection to a trough which receives the electrolyte before flowing into a plating bath reservoir. Alternatively, or in addition, the pressure regulator may include a vent mechanism. In the depicted embodiment, an optional vent hole 526 is included under a finger of cap 520. The finger is designed to prevent spraying electrolyte from directly passing out of regulator 502.

As noted, an open loop design such as that described herein maintains a substantially constant pressure in the anode chamber. Thus, in some embodiments, it is unnecessary to monitor the pressure of the anode chamber with a pressure transducer or other mechanism. Of course, there may be other reasons to monitor pressure in the system, for example to confirm that the pump is continuing to function and circulate electrolyte.

The apparatus and processes described hereinabove may be used in conjunction with lithographic patterning tools or processes, for example, for the fabrication or manufacture of semiconductor devices. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light through a mask using a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper. This process may provide a pattern of features such as Damascene, TSV, RDL, or WLP features that may be electrofilled with silver tin using the above-described apparatus. In some embodiments, electroplating occurs after the resist has been patterned but before the resist is removed (through resist plating).

As indicated above, various embodiments include a system controller having instructions for controlling process operations in accordance with the present invention. For example, a pump control may be directed by an algorithm making use of signals from the level sensor(s) in the pressure regulating device. For example, if a signal from a lower level sensor shown in FIG. 5 indicates that fluid is not present at the associated level, the controller may direct that additional make up solution or DI water be provided into the anolyte recirculation loop to ensure that there is sufficient fluid in the line that the pump will not operate dry (a condition which could damage the pump). Similarly, if the upper level sensor signals that fluid is present in the associated level, the controller may direct may take steps to reduce the amount of recirculating anolyte, as explained above, thereby ensuring that the filtered fluid in the pressure regulating device remains between the upper and lower levels of the sensors. Optionally, a controller may determine whether anolyte is flowing in the open recirculation loop using, for example, a pressure transducer or a flow meter in the line. The same or a different controller will control delivery of current to the substrate during electroplating. The same or a different controller will control dosing of make up solution and/or deionized water and/or additives to the catholyte and anolyte.

The system controller will typically include one or more memory devices and one or more processors configured to execute the instructions so that the apparatus will perform a method in accordance with the present invention. Machine-readable media containing instructions for controlling process operations in accordance with the present invention may be coupled to the system controller.

Regeneration of Metals

As it was previously mentioned, it is desirable to regenerate some or all of one or both metals from spent electrolyte, and, preferably reuse them in the plating apparatus. A regeneration method employing electrowinning of silver was described with reference to FIG. 4. A description of alternative methods for regenerating one or both of metal 1 (less noble metal) and metal 2 (more noble metal) follows. In one embodiment, the solutions used in the tool are low alpha tin electrolytes (solutions contain little alpha particle generating materials), metal 1 anode are low alpha tin anodes (the metal contains little alpha particle generating metals), and metal 2 is silver. The following methods are described in terms of tin silver plating, however, one of ordinary skill in the art would appreciate that metals that may be characterized as metal 1 (less noble) and metal 2 (more noble) will also work. In certain embodiments, one or both of the metal ion sources is regenerated and reintroduced into the plating system.

Figure 6:
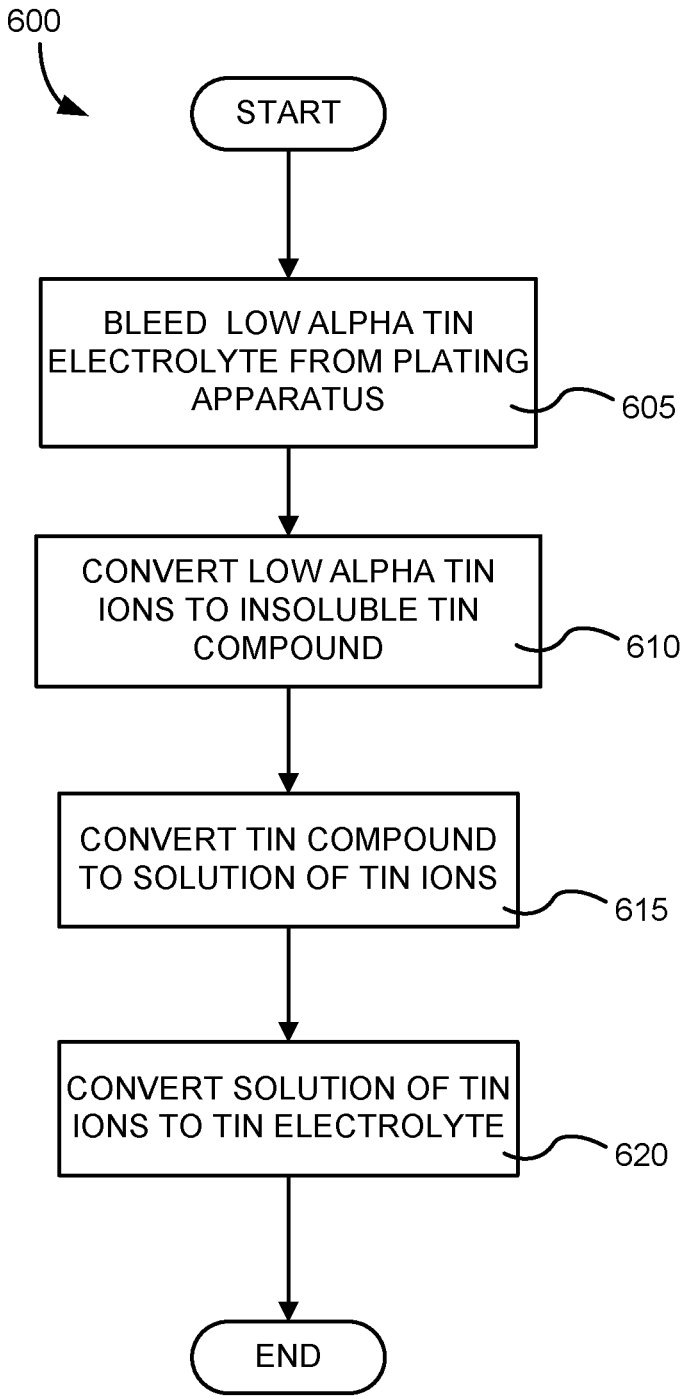
FIG. 6 is a process flow diagram for a method of recovering metals from electrolyte in accordance with an embodiment provided herein.

FIG. 6 outlines a method, 600, of regenerating a low alpha tin electrolyte solution, including: 1) removing a low alpha tin ion containing electrolyte from a catholyte of the plating apparatus (see 605), 2) converting and separating tin from the solution the low alpha tin solution as a solid insoluble compound form of low alpha tin, such as stannous oxide (SnO) and/or stannous hydroxides ($Sn(OH)_2$) (see 610), 3) converting the insoluble form of low alpha tin (such as oxide or hydroxides) into a solution of low alpha tin ions (see 615), and 4) converting the solution of low alpha tin ions into low alpha tin electrolyte for re-introduction into the plating system anolyte (see 620), which may include adjusting it to a suitable concentration, acidity, etc. In certain embodiments the regenerated low alpha tin electrolyte is reintroduced into the plating apparatus during plating. In some embodiments the regenerated low alpha tin is reintroduced into the anode chamber of the plating apparatus during plating. In some embodiments, the silver component of the electrolyte is also reconstituted into a solution of silver ions for use in the electrolyte. In some embodiments, the silver component of the electrolyte is separated from the tin containing component and is also reconstituted into a solution of tin-free silver ions for use in the electrolyte. In some embodiments, the low alpha tin electrolyte solution is treated to remove organic components prior to converting the low alpha tin ions into the low alpha tin oxide. More details of various embodiments are described below in relation to the Figures.

When acid-containing solution is added to the anode chamber and tin ion solution is transferred to the cathode chamber, as described in FIG. 2A, the problem of catholyte dilution and acid buildup in the catholyte must be addressed. Embodiments described herein address these issues and also provide methods of regenerating the expensive low alpha tin electrolyte, and in some embodiments recirculating the regenerated electrolyte back into the plating apparatus. In some embodiments, high tin content and low acid electrolyte from the anode chamber is fed directly into the cathode chamber (or into the plating reservoir fluidically connected to the cathode chamber) and is replaced in the anode chamber with a solution of lower tin and higher acid content than resides in the anode chamber. This reduces the buildup of tin ions and replaces the necessary current-carrying acid in the anode chamber, while concurrently increasing the concentrations of tin and reducing the acid content in the cathode chamber. The acid and water that are fed into the anode chamber compensate for the electrochemically depleted acid and water that transports across the membrane separator. Also, some water is introduced (fed) into the cathode chamber along with the silver ions from the silver make up solution and with the solution containing plating additives making up for additives degraded and/or consumed by electrolysis. These water additions tend to dilute the tin (and acid) content in the plating reservoir and catholyte. In this system as a whole, the total amount of water, acid and salts should be balanced. Therefore, in this embodiment, illustrated in FIG. 2A, some amount of electrolyte from the cathode chamber must be bled out to offset the influx of electrolyte from the anode chamber, silver ion makeup-dosing, additive dosing, water drag and hydrogen ion transport across the separator. Further, tin-containing solution must be added to the anolyte chamber to compensate for the tin extracted from the cell to make up for the tin lost by the catholyte bleed steam. Catholyte bleed, in turn, is needed to make room for the fluid volume of the cascading material from the anolyte to the catholyte that allows the anode-generated tin to reach the cathode chamber.

The bled catholyte includes a significant amount (e.g. half or more) of the amount of low alpha tin ion that is plated, which represents a significant waste and expense. Therefore, in some embodiments, regeneration processes for recovering this high value low alpha tin ions and using them to replenish the electrolyte and recirculate them as a cascade transfer medium rather than as a waste stream, are provided.

In accordance with Pourbaix (also known as pH-stability) diagrams of uncomplexed tin and silver ions, silver ion is stable at pH levels from −2 to about 8, but tin ions are only stable at pH<2. In the complexed state, silver ions may be stable over a broader pH range. In certain embodiments, these solubility characteristics of tin and silver ions are exploited in order to isolate, separate and in some instances reconstitute the ions for reintroduction into the plating system.

Referring to FIGS. 7-10, four exemplary methods of regenerating tin electrolyte are described. In all four of the depicted regeneration methods, precipitated insoluble tin oxide or other precipitated species from the in-process regeneration material is optionally rinsed to remove entrained organics and silver, and redissolved using appropriately concentrated acid of the plating electrolyte (e.g. with concentrated methanesulfonic acid), and then reintroduced to the plating system, for example, to the anode chamber and/or the cathode chamber. Tin can also be redissolved at a lower pH by introducing a tin complexing agent, such as with oxalate anion.

In some embodiments, the silver is also recovered, e.g. via a precipitation reaction, although this is not always necessary. In the embodiments in which silver is precipitated, at least two separate chambers are required outside the plating cell. One of these chambers is used to precipitate the tin compound (at a range of 2<pH<4 for the first chamber process fluid) and the other chamber is used to precipitate a silver compound (at a pH>8). One of ordinary skill in the art would appreciate that less than the total number of reactor vessels may be used to treat, isolate, precipitate, redissolve precipitate, etc. In one embodiment a tin concentrate solution is created by this procedure (e.g. a solution having tin ion concentration of 200-350 g/L, and acid concentration of 20-120 g/L), which is subsequently mixed with and diluted with water and acid to create a "low tin"/"high-acid" concentration as needed for the anolyte feed in the process described herein. In another embodiment, the low tin, high acid concentration solution is created, suitable for direct injection into the anolyte chamber (e.g. having tin concentration of about 70-120 g/L, acid concentration of about 180 to 250 g/L), if manufactured directly.

In all embodiments, a carbon filtration system is optionally employed to remove organic components in cases where they may precipitate in combination with the metals, for example, degraded grain refiner and complexing components from the stream bled out of the cathode chamber. If the organic compounds remain dissolved under conditions where the metal oxides or salts are formed, than they can be removed with the filtrate. In other cases, the organic additives are not removed and are circulated through the system, and the replacement of breakdown products is accomplished by continuously removing a fraction of the bleed stream to waste and adding additional additive and complexers as required. This is a natural requirement as the amount of tin in the bleed stream is generally larger than that in the feed stream, since excess tin is created at the anode vs. plated at the cathode due to the deposition of silver (an exception to this is when an active silver anode is used in the catholyte chamber).

Figure 7:
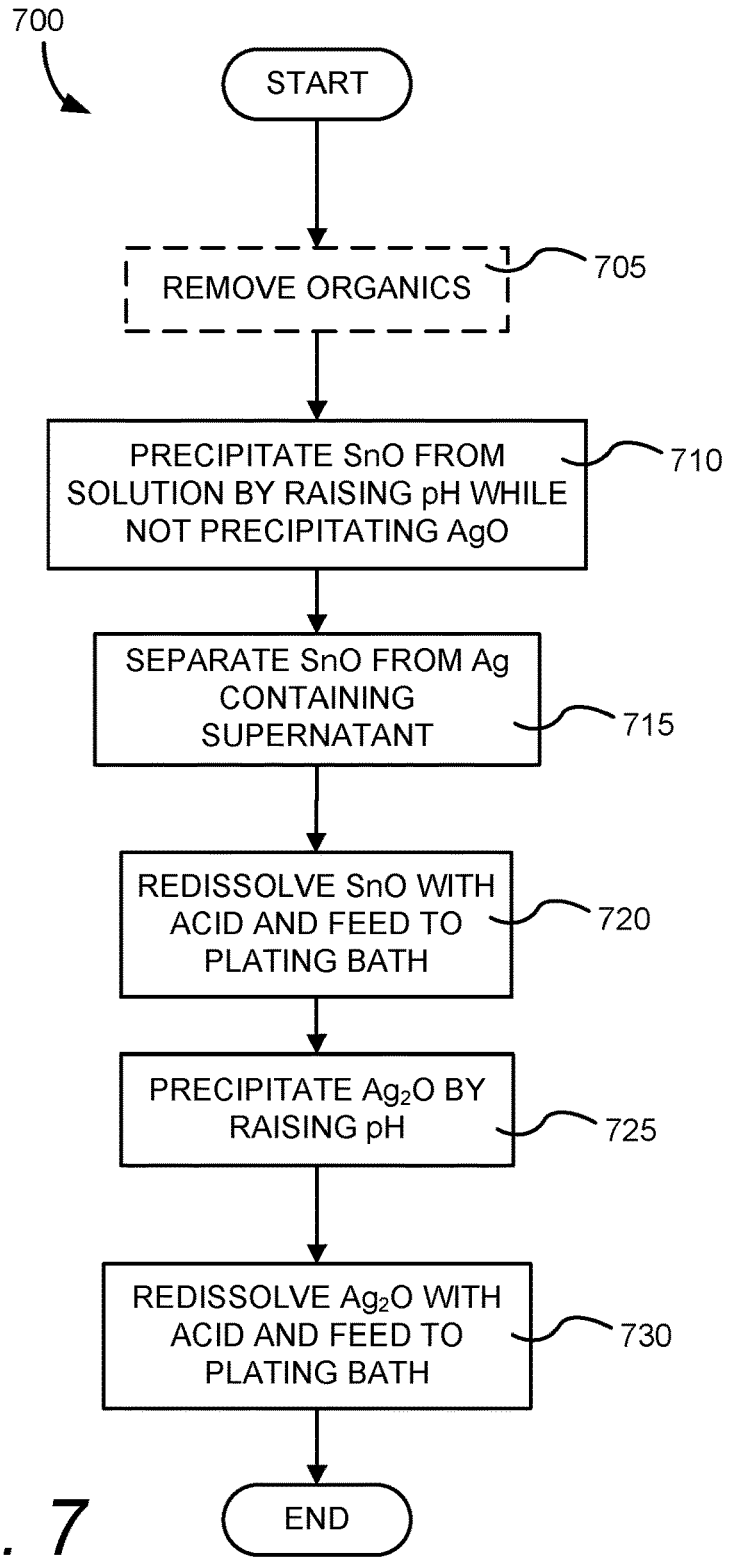
FIG. 7 is a process flow diagram for a method of recovering metals from electrolyte in accordance with an embodiment provided herein.

In the embodiment described in relation to method 700 of FIG. 7, after optionally removing organics (see 705), for example via activated carbon filtration, a stream bled from the cathode chamber is initially treated with sufficient base to precipitate tin compounds but not precipitate silver oxide or other silver species, see 710. Achieving the appropriate precipitation-titration pH end point may be facilitated by pre-measuring the free acid and tin concentration of the solution, then adding a non-metal-ion complexing buffer, such as a weak acid (e.g. acetic acid, boric acid, hydrogen potassium di-phosphate, etc.) to the stream, and adding a slight excess amount of alkali as would be required based on the measurements of tin and free acid. This procedure can avoid the use of more costly, less pH-range robust, and less reliable equipment, such as pH meters (pH range will vary from as much as −1.5 to 8 or more in this operation). The precipitated tin material is then rinsed of soluble silver and additives and is separated from its supernatant, see 715. The tin precipitate is then re-dissolved in concentrated acid of the desired salt for the bath, for example, methanesulfonic acid, see 720. From there, it is reintroduced into the anode chamber. The optimal concentration of the regenerated tin/acid solution that will keep the cell in optimal balance depend on the current, catholyte concentrations, bleed and feed rate, etc., but are generally lower in tin and acid than the main electrolyte, because the catholyte is diluted by other water incoming streams (water coming from the silver makeup and additive makeup that is removed from the bath in the catholyte bleed). As above, a fraction of the bleed stream may be removed as was before or after the tin electrolyte reconstitution phase. Optionally, some or all of the supernatant from the portion of the tin regeneration process where tin compounds are initially precipitated is delivered to a different chamber where the silver oxide is precipitated by raising the pH further, see 725. The precipitation is driven by adding sufficient base to raise the pH of the solution to a point where silver is no longer soluble. Precipitated silver oxide is rinsed and re-solubilized in concentrated methanesulfonic acid. The resulting silver acid solution is then recycled back into the cathode chamber, see 730. The method is then done.

Figure 8:
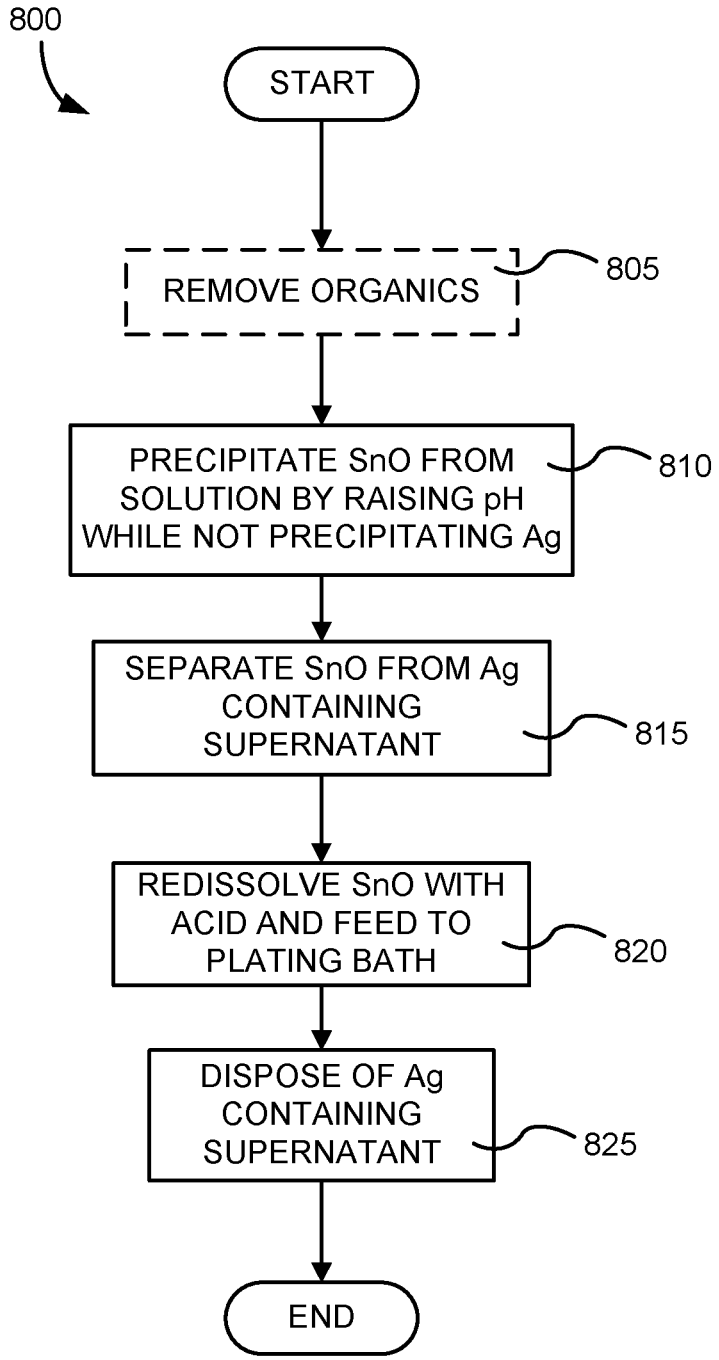
FIG. 8 is a process flow diagram for a method of recovering metals from electrolyte in accordance with an embodiment provided herein.

In the embodiment described in relation to method 800 of FIG. 8, after an optional organic removal (see 805), a tin containing solution bled from the cathode chamber is treated with a base as before to precipitate a tin oxide and/or hydroxide, see 810. The precipitate is separated from the silver containing supernatant, see 815. The precipitate is then washed or rinsed and re-solubilized in concentrated methanesulfonic acid before being reintroduced into the anode chamber, see 820. Thus, insofar as the low alpha tin is concerned, this process is identical to the previous one. However, insofar as the silver is concerned, it is different. The supernatant from the tin oxide precipitation reaction is discarded, and with it the dissolved silver, see 825. The method then ends. In theory, this regeneration process could employ a single vessel aside from the plating cell. It is important to note that although silver is a precious metal, the relative cost of the silver and the amount present for plating as compared to the cost of low alpha tin may make disposal of the silver supernatant cost effective. As an alternative, particular useful when the silver recovery is desired for monetary or environmental reasons and silver precipitation is not a suitable option (e.g., the complexing agent strength is prohibitive), then the supernatant, now free of tin but containing the silver, can be process in an electrowinning apparatus to plate out the silver as a high purity silver deposit.

Figure 9:
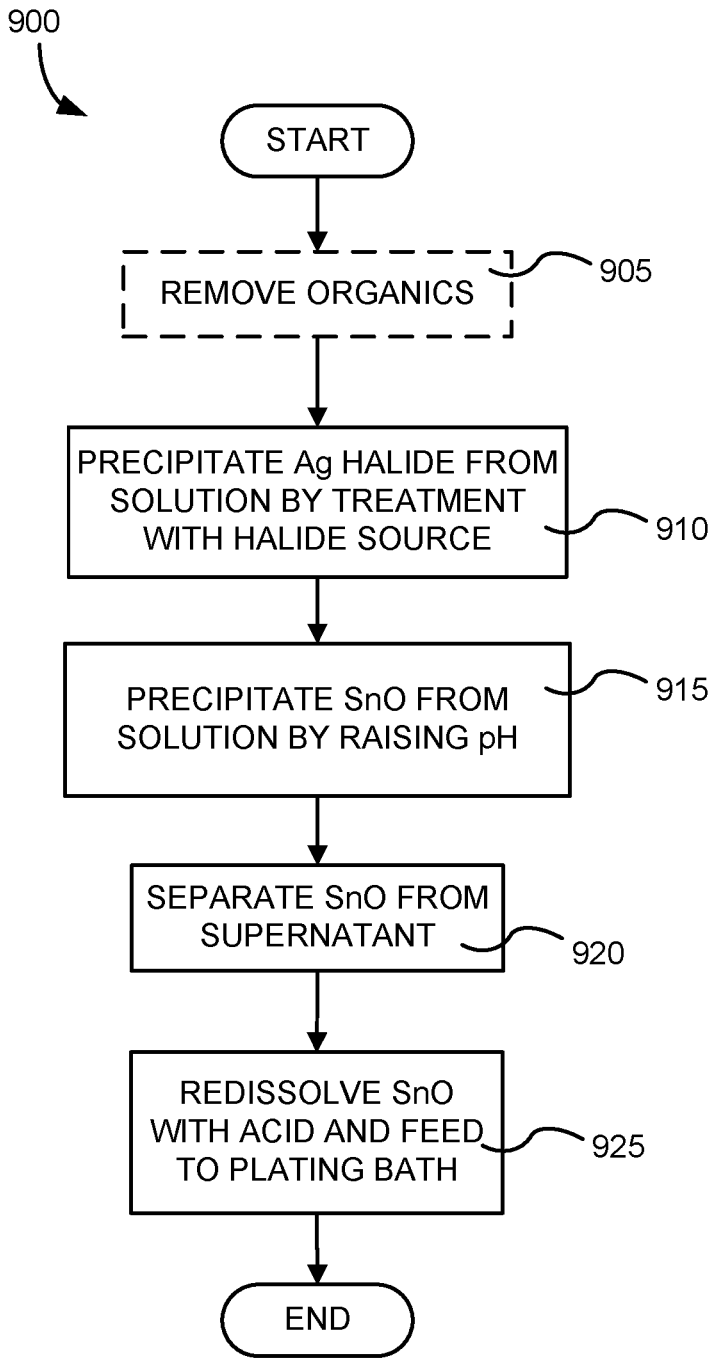
FIG. 9 is a process flow diagram for a method of recovering metals from electrolyte in accordance with an embodiment provided herein.

In the embodiment described in relation to method 900 of FIG. 9, after an optional organic removal (see 905), electrolyte bled from the cathode chamber is first treated to remove silver ions by precipitating them with a concentrated alkali or similar anion source with a solubility constant lower than the free silver ion concentration of the complex, such as a silver chloride, bromide, iodide, carbonate or sulfide, for example, see 910. When sources of chloride ion are used, such as NaCl, silver chloride would be precipitated. The precipitated silver chloride may be discarded. Then, the supernatant is treated with base to raise its pH to a level at which the dissolved tin precipitates, see 915. In one embodiment, the pH is raised above 1, preferably above 2, but less than 8 so that silver ions, if any remain after the halide precipitation, are not precipitated. The precipitated tin is then rinsed and re-dissolved in concentrated methanesulfonic acid and reintroduced to the anode chamber, see 925. The method then ends. As above, in cases where the silver complexing agent is particularly strong so the amount of free silver is exceedingly low (below the Ksp of silver in silver chloride, silver chloride solubility is $\sim 10^{-5}$ g/L), then this method for precipitating the silver as a chloride may not work. An alternative method for removing strongly complexed silver from the filtrate solution is to form the sulfide by reaction with $H_2S$ in near neutral solutions, filtering the silver, and re-dissolving the tin ($Ag_2S$ solubility $\sim 10^{-15}$ g/L).

Note that in these various embodiments, the dissolution of the precipitated tin compound can be performed under conditions and in amounts such that the resulting acid solution of tin has the same concentration as a tin concentrate solution or any variety of concentration of tin and acid, and can be used as such in operating plating cells.

Figure 10:
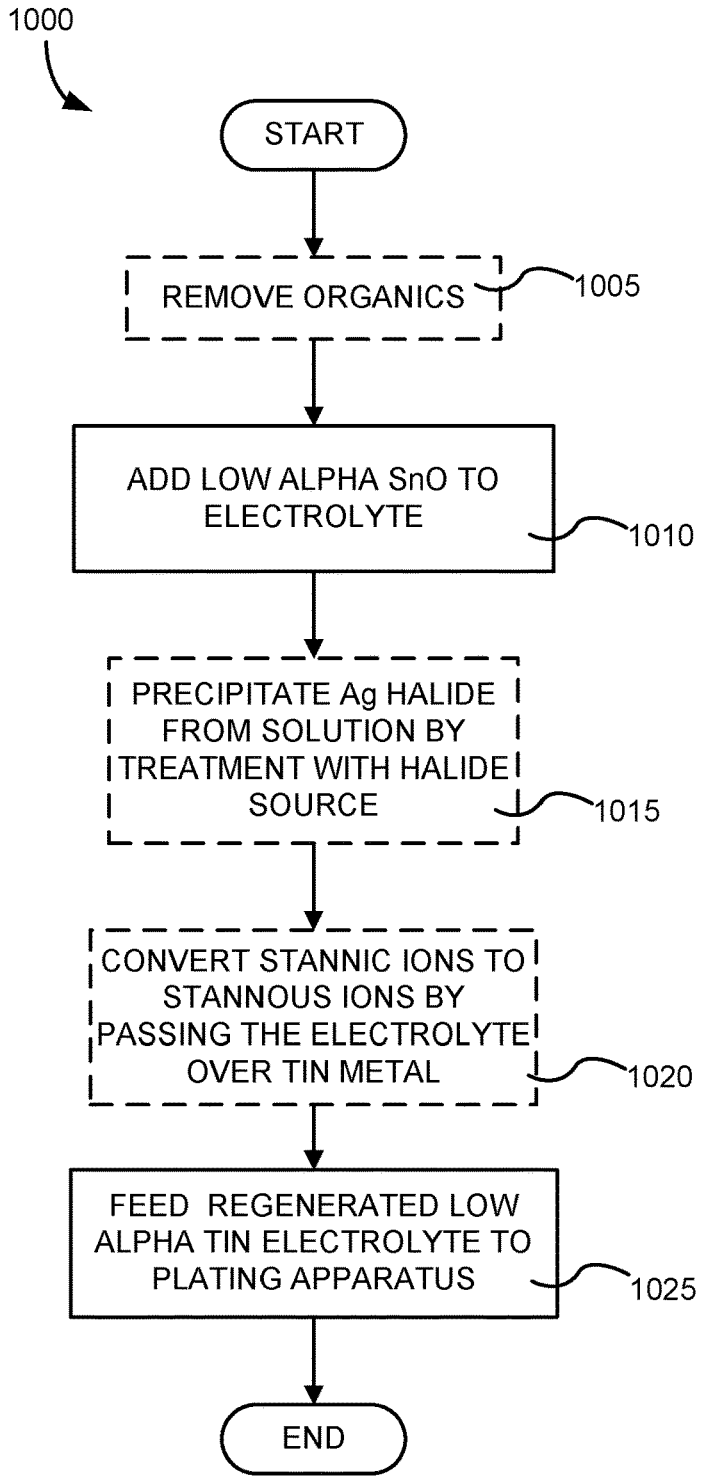
FIG. 10 is a process flow diagram for a method of recovering metals from electrolyte in accordance with an embodiment provided herein.

The final depicted regeneration process is described in relation to method 1000 of FIG. 10. This process is somewhat different from those described previously in that a dimensionally stable inert anode is employed in place of a consumable tin anode. Thus, a different source of tin must be provided to the plating cell. In the depicted embodiment, the source of tin is a tin oxide slurry that is mixed with the stream bled from the cathode chamber. The bleed catholyte or the electrolyte of the anode chamber are maintained at a very low pH (e.g., about zero), such that the tin oxide dissolves easily to produce stannous ions. During a plating process, after electrolyte is in need of regeneration, electrolyte is bled from the cathode chamber, and optionally the organics are removed by carbon treatment, see 1005. In a slightly different embodiment (not shown) the organics are removed from tin (and possibly silver) by 1) first raising the pH of the bled solution, precipitating the tin originally in the solution as tin oxide (and optionally also precipitating the silver as silver oxide), 2) removing the filtrate and rinsing the filtered oxides, 3) adding make-up tin oxide (and optionally silver oxide) slurry (equal to the amount plated on the wafer), 4) adding acid to re-dissolve the oxides of the metals, and 5) reintroducing the solution to the bath as regenerated, additive free solution with a higher concentration of tin (and/or silver) than was removed. In general in this scheme, further low alpha tin oxide, for example a concentrated slurry in water, is added to the bled electrolyte from the cathode chamber, see 1010. The electrolyte contains strong acid (or can be added) resulting in formation of more tin ions. In some cases the resulting solution may be evaporated to achieve a desired concentration before delivering it back to the cathode chamber. In a further optional process, any existing stannic ions are reduced to stannous ions prior to reintroduction to the plating cell, for example, by contacting the solution over tin metal. As noted, when using an inert anode, oxygen is liberated during the plating process, which tends to oxidize the stannous ions present in the anode chamber to stannic ions. The oxygen may be segregated from the catholyte by using a flow and bubble impervious membrane such as Nafion, and the anolyte may contain at a minimum only acid. Stannic ions are undesirable, and should be removed and/or converted to stannous ions before they can accumulate in the plating cell. In the depicted embodiment, this is accomplished by first precipitating silver chloride from the solution to be regenerated (see 1015) and then passing the solution over tin metal, for example, through a packed bed containing metallic tin, see 1020. The metallic tin reacts with stannic ions to produce to stannous ions. One can also filter from the solution prior to reintroduction of reconstituted electrolyte into the cell (e.g. by passing the solution through a 0.05 um or smaller rated filter). Of course, if dissolved silver ions are present in the solution passed over the tin packed bed, a displacement reaction would take place in which silver ions are reduced to silver metal that coats the metallic tin and destroys its effectiveness. The regeneration electrolyte may pass over the packed bed several times until the silver concentration achieves the target low concentration (e.g. <0.1, more preferably <0.01 g/L). The regenerated low alpha tin electrolyte is then returned to the plating apparatus, in this example, if the silver is removed to the anode chamber, if the optional silver removal is not performed, then the regenerated electrolyte is returned to the cathode chamber. The method then ends.

The methods described herein can be implemented in and as an integrated part of the plating tool apparatus, i.e. they are integrated together with the plating tool, including the bath metrology and control systems. As an alternative, the bleed bath materials can be moved to a separate backroom and one can implement apparatus in the fabrication facility to regenerate the electrolytes and return them to the plating tool. By analogy, some modern fabrication facilities have sub fab back room for waste treatment and metal recovery apparatus for removing copper from the plating solution (typically involving electrowinning and ion-exchange operations), but the plating solution are not regenerated on the tool or at the facility for reuse. Rather, new solution are fed, metal is sometime recovered on site, and the remaining liquid solution are treated or removed as waste. Regeneration apparatus described herein preferably is part of the plating tool, or less favorably but suitably reside in a portion of the fabrication facility where various chemical supplies are provided to the entire fab. Examples of such supplies include supplies of fresh plating solution, deionized water, etc. The bleed material from the tool can of course also be removed from the fabrication site, and regenerated by reprocessing off site and thereafter returned to the facility, though this involves transportation of potentially large volumes of hazardous materials adding cost and logistical issues. These back room and off site procedures are still considered regeneration processes within the scope of the invention.

Referring to an example of mass balance of a plating cell under steady state operation, provided in reference to FIG. 2A, it can be seen that material return to the system in the anode chamber is not the same in concentrations as that that is removed from the catholyte chamber and that the described operating parameters would lead to a steady state operation. A key feature in this example is the ability to remove the silver and concentrate the regenerated solution with respect to tin and acid, which is a feature applicable to other embodiments described herein. However, if one simply removes silver (e.g. by precipitation, displacement with tin, or electrowinning), one can add an appropriate amount of tin and acid to the solution to achieve the appropriate higher tin and acid concentrations, which is an economical approach as well.

Alternative Embodiments

While in many embodiments described above the separator structure includes a cation-exchange membrane, such as Nafion, in alternative embodiments the separator can have a structure as follows.

In some embodiments the separator provides a quiescent region, where no convection occurs, allowing a gentle concentration gradient of metal 2 ions (e.g., silver) to establish. This minimizes the driving force for diffusion of metal 2 ions into the anode chamber. In one embodiment, the separator includes at least one membrane that substantially blocks transport of organic electroplating additives and separator also includes a porous internal structure that maintains the electrolyte contained therein in a substantially quiescent state. In one embodiment, separator is between about 1 cm and about 5 cm thick. The separation structure is substantially rigid so as not to disturb the quiescent region. By virtue of having such a separator structure, metal 1 ions and metal 2 ions both occupy the catholyte and therefore both are plating together onto the wafer, however, virtually no metal 2 ions enter the anolyte and therefore issues with metal 2 depositing onto anode 210 are avoided.

In one implementation the separator structure includes a first membrane, a porous support, and a second membrane, where the porous support is sandwiched between the first and second membranes. In one embodiment, each of the first and the second membrane are cationic membranes, such as, but not limited to, those described in the following U.S. Pat. Nos. 6,126,798 and 6,569,299 issued to Reid et al., U.S. patent application Ser. No. 12/337,147, entitled Electroplating Apparatus With Vented Electrolyte Manifold, filed Dec. 17, 2008, U.S. Patent Application Ser. No. 61/139,178, entitled PLATING METHOD AND APPARATUS WITH MULTIPLE INTERNALLY IRRIGATED CHAMBERS, filed Dec. 19, 2008, each of which is incorporated herein by reference in its entirety. Porous support has a porous structure and is substantially rigid so as to provide a support structure for membranes above and below it. In one embodiment, the porous support is a sintered plastic material, for example, Porex™ (a brand name for sintered polymeric materials, commercially available from Porex Corporation of Fairburn, Ga.), although any porous material that is resistant to the electrolyte so as to negatively affect plating performance will suffice. Other examples include sintered porous glass, porous sintered ceramics, solgels, aerogels and the like. In one embodiment, the pores in the porous support are in the size regime of angstroms to microns. In one embodiment the pores are between about 50 Å and about 100 μm in average diameter. Hydrophillic materials with smaller pores are preferred as they are more resistive to convective flow. In this example, the quiescent region is formed by virtue of the porosity and thickness of porous support. Porous support typically, but not necessarily, has larger pore size than the membranes sandwiching it.

As mentioned, resistance to passage of metal 2 ions to the anode chamber is achieved by virtue of the quiescent region established in the separator structure.

First, diffusion through such separator will be discussed. In the example of tin and silver plating, silver ions (metal 2 ions) are introduced into the cathode chamber. The concentration difference in silver ions across the separator will drive silver ions toward the anode chamber and similarly the concentration difference in tin ions across the separator will drive tin ions toward the cathode chamber. Since the ionic radii of $Sn^{+2}$ and $Ag^{+1}$ are nearly the same, 112 picometers and 115 picometers, respectively, and $Sn^{+2}$ ions must pass from the anode chamber through the separator structure into the cathode chamber, the pores of each of the membranes and the porous support must be large enough to allow this transport. So, diffusion of silver ions into the anode chamber, although undesirable, is possible if the only (or overriding) mode of mass transport were diffusion. The first membrane of the separation structure is the first barrier that the silver ions must traverse in order to arrive at the anode chamber. Although membranes and porous support do not have pores small enough to exclude silver ions, there is a barrier to silver ions passing through the sandwiched structure by virtue of the quiescent region established therebetween.

The second mass transport phenomenon is electromigration due to the electric field established between the cathode and the anode. This drives metal ions, both silver and tin, toward the wafer. This driving force goes against diffusion driving force for silver ions into and through the quiescent region established by the separator structure, while at the same time favors transport of tin ions through the separator structure.

Third, there are convective forces. Electrolyte is pumped into the anode chamber, and particularly onto the anode itself to prevent passivation. Additionally, the wafer is rotated in the cathode chamber, thereby setting up convective flows. Convection in the catholyte brings fresh silver ions in separator surface to maintain a relatively high concentration of silver at the separator, which concentration would be otherwise lower due to slight diffusion into the separator. Conversely convection in anode chamber clears out any silver ions at the separator interface immediately after they make their way into the anode chamber. The convection in the cathode and anode chambers maintains an artificially high concentration gradient across the separator and therefore promotes diffusion.

In some embodiments, anolyte is pumped through porous support of the separation structure in order to periodically flush any silver ions that may have entered the separator structure. By virtue of the small pore size of each of membranes in the separation structure relative to the pore size of the porous support, during these flushes, the bulk of the flushes traverse laterally through the porous support and out to an exit. In one embodiment, the exiting flushes are introduced into the catholyte and a corresponding amount of catholyte is drained. In one embodiment, these periodic flushes are performed as part of a bleed and feed process of replenishing acid and/or other electrolyte components in order to maintain steady state plating conditions.

Therefore, although not wishing to be bound by theory, it is believed that by virtue of the quiescent region of the separator structure and periodic flushing of the porous support of the separator structure, virtually no silver ions enter the anode chamber during plating.

In a some embodiments, the separator between the anode and cathode chambers provides various functions which may include the following: (1) impeding passage of ions of the more noble metal (e.g., silver ions) from the cathode chamber to the anode chamber, (2) preventing organic plating additives (e.g., accelerators, suppressors, and/or levelers and their decomposition and byproducts) from passing from the cathode chamber to the anode chamber, and (3) preventing fluid from passing between the anode and cathode chambers (optional).

A separator between the anode and cathode chambers may have one or more of the following structural features: (1) pores in at least part of the structure which pores are sufficiently small to prevent fluid flow (e.g., about 50 A to 100 micrometers) and (2) a thick non-convecting portion which prevents convection within the separator (e.g., a the non-convecting portion is about 0.5 to 1 inch thick). In one specific embodiment, the separator is a sandwich structure including two sheets of a cationically conducting polymer (e.g., an ionomer such as Nafion™) straddling a porous but non-convecting section (e.g., a sintered glass or plastic). In slight variations of this embodiment, the two sheets of polymer are different materials, although they both conduct cations. Further, the porous middle section need not be a monolithic layer but may include two or more separate layers. In an alternative embodiment, the entire separator is simply a rather thick cation conducting membrane, on the order of about 0.5 to 1 inch thick.

In other alternative embodiments, the use of an inert or dimensionally stable anode is considered. The use of such anode might have the benefit of avoiding an increase in tin concentration within the anode chamber characteristic of a separated anode chamber as described above. However, a dimensionally stable anode operates at a high voltage in order to generate acid and molecular oxygen during normal plating. One unfortunate result of this is that the oxygen oxidizes the stannous ions to stannic ions, which can precipitate from the solution and throughout the cell as well as on the surfaces of the deposit, resulting in void formation. Using a dimensionally stable anode, over time, degrades the electrolyte as indicated by the transformation of the electrolyte into a dark yellow and cloudy anolyte as compared to a system in which a consumable tin anode is used, which does not suffer from this degradation. The yellow cloudy solution indicates that stannic ions are formed and they induce formation of flocculent precipitates of stannic oxide, which can precipitate and adhere to plating tool surfaces, clog filters and the like, as well as degrade the quality of the solder (creating entrapped voids in the bumps and bump failure).

Although the foregoing invention has been described in some detail to facilitate understanding, the described embodiments are to be considered illustrative and not limiting. It will be apparent to one of ordinary skill in the art that certain changes and modifications can be practiced.

The invention claimed is:

1. An apparatus for simultaneous electroplating of a first metal and of a second, more noble metal on a cathodically biased substrate, comprising:

(a) a cathode chamber for housing the cathodically biased substrate and a catholyte during electroplating, wherein the cathode chamber comprises an inlet and an outlet;

(b) an anode chamber for housing an active anode and an anolyte, wherein the anode chamber comprises an inlet and an outlet;

(c) a separation structure between the cathode chamber and the anode chamber, wherein the separation structure is permeable to water and protons but is configured to substantially prevent ions of the second metal from passing through the separation structure from the cathode chamber to the anode chamber during electroplating;

(d) a fluidic conduit, other than the separation structure, between the anode chamber and the cathode chamber and (e) a controller programmed for simultaneous electroplating of the first and second metals on the cathodically biased substrate, the controller including program instructions for causing:

(i) a cathodic bias at the substrate that is sufficient to cause electrodeposition of the first and second metal on the biased substrate from the catholyte containing ions of the first and second metal, and is also sufficient to cause transfer of water through the separation structure from the anode chamber to the cathode chamber during electroplating;

(ii) delivery of an acid solution to the anode chamber via the inlet in the anode chamber, from a source outside the anode chamber;

(iii) removal of a portion of catholyte from the catholyte chamber via the outlet in the cathode chamber to make room for a volume of fluid that is transferring from the anode chamber to the cathode chamber;

(iv) delivery of ions of the second metal to the cathode chamber;

(v) delivery of the anolyte from the anode chamber to the cathode chamber via the fluidic conduit, wherein the volume of fluid that is transferring from the anode chamber to the cathode chamber comprises a volume of water that is transported from the anode chamber to the cathode chamber through the separation structure and a volume of anolyte that is delivered from the anode chamber to the cathode chamber through the fluidic conduit, wherein the program instructions cause maintenance of proton concentration in the catholyte such that it does not fluctuate by more than about 10% over the period of at least about 0.2 bath charge turnovers.

2. The apparatus of claim 1, wherein the separation structure comprises a cationic membrane, configured for allowing transport of protons, water, and ions of the first metal from anolyte to catholyte during plating.

3. The apparatus of claim 1, wherein the first metal is tin and the second metal is silver.

4. The apparatus of claim 1, wherein the apparatus comprises the active anode housed in the anode chamber, wherein the active anode comprises low alpha tin.

5. The apparatus of claim 1, further comprising a pressure regulator in fluid communication with the anode chamber.

6. The apparatus of claim 5, wherein the pressure regulator comprises a vertical column arranged to serve as a conduit through which the electrolyte flows upward before spilling over a top of the vertical column, and wherein, in operation, the vertical column provides a pressure head which maintains a substantially constant pressure in the anode chamber.

7. The apparatus of claim 5, wherein the pressure regulator is incorporated into an anolyte circulation loop which circulates anolyte out of the anode chamber, through the pressure regulator, and back into the anode chamber.

8. The apparatus of claim 7, wherein the anolyte circulation loop further comprises an inlet for introducing additional fluid comprising a component selected from the group consisting of water, acid, and ions of the first metal, into the anolyte circulation loop.

9. The apparatus of claim 1, further comprising a source comprising a component selected from the group consisting of water, acid, and ions of the first metal fluidically coupled with the anode chamber.

10. The apparatus of claim 1, wherein the second metal is silver, and wherein the apparatus further comprising a source of silver ions fluidically coupled to the cathode chamber.

11. The apparatus of claim 1, wherein the second metal is silver, and wherein the apparatus further comprises a silver anode fluidically coupled to the cathode chamber, wherein the silver anode is configured to be electrochemically dissolved into the catholyte and thereby provide silver ions to the catholyte, but not to the anolyte.

12. The apparatus of claim 1, further comprising a pump associated with the fluidic conduit which enables transfer of anolyte to the catholyte either directly or via a reservoir.

13. The apparatus of claim 1, wherein the first metal is tin and the second metal is silver, wherein the apparatus further comprises a structure configured for:

receiving the removed portion of catholyte;

separating tin from silver in the removed portion of catholyte; and forming a first solution comprising tin ions and/or a second solution comprising silver ions, wherein at least one of said solutions is suitable for reuse.

14. The apparatus of claim 13, wherein the apparatus comprises an electrowinning station configured for electrowinning silver from the removed portion of catholyte under controlled potential, wherein the controller further comprises program instructions for causing a delivery of a tin-containing silver-free solution obtained after electrowinning to the anode chamber.

15. The apparatus of claim 1, wherein the controller is configured for controlling electrolyte composition using coulemetric data.

16. The apparatus of claim 1, wherein the controller comprises program instructions for causing maintenance of substantially constant compositions of the anolyte and of the catholyte.

17. The apparatus of claim 1, wherein the first metal is tin and the second metal is silver, wherein the controller comprises program instructions for causing regeneration of tin from removed portions of catholyte by electrowinning silver from removed portions of catholyte.

18. The apparatus of claim 1, wherein the controller further comprises program instructions for causing a delivery of ions of the first metal to the anode chamber.

19. A system, comprising the apparatus of claim 1 and a stepper.

* * * * *